US006758923B2

(12) United States Patent
Butterworth et al.

(10) Patent No.: US 6,758,923 B2
(45) **Date of Patent: *Jul. 6, 2004**

(54) APPARATUS AND METHOD FOR APPLYING ADHESIVE IN A WEB CONVERTING MACHINE

(75) Inventors: Tad T. Butterworth, Ashland, WI (US); John W. LaChapelle, Jr., Ironwood, MI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 116 days.

This patent is subject to a terminal disclaimer.

(21) Appl. No.: 10/096,084

(22) Filed: Mar. 12, 2002

(65) Prior Publication Data

US 2002/0170649 A1 Nov. 21, 2002

Related U.S. Application Data

(63) Continuation-in-part of application No. 09/459,517, filed on Dec. 13, 1999, now Pat. No. 6,372,064.

(51) Int. Cl.[7] ..... B32B 31/00; B65H 81/00

(52) U.S. Cl. ..... 156/64; 156/187; 156/357; 156/450; 156/578

(58) Field of Search ..... 156/64, 187, 357, 156/446, 448, 449, 450, 578, 152

(56) References Cited

U.S. PATENT DOCUMENTS

| | | | |
|---|---|---|---|
| 1,326,043 | A | 12/1919 | Flugel |
| 1,391,281 | A | 9/1921 | Snyder |
| 1,967,751 | A | 7/1934 | Goerlich |
| 2,192,453 | A | 3/1940 | Rentsch |
| 2,357,476 | A | 9/1944 | Kaulen |
| 2,573,188 | A | 10/1951 | Dyken |

(List continued on next page.)

FOREIGN PATENT DOCUMENTS

| | | |
|---|---|---|
| DE | 1511076 | 10/1970 |
| DE | 2518902 | 11/1976 |

(List continued on next page.)

OTHER PUBLICATIONS

SIMCO, Brochure, Oct. 1993, 3 pages, Publication No. 5200522 Rev B, USA.

(List continued on next page.)

*Primary Examiner*—Mark A. Osele
(74) *Attorney, Agent, or Firm*—Michael Best & Friedrich LLP

(57) ABSTRACT

An apparatus and method for applying adhesive in a web converting machine is disclosed. In some embodiments, an adhesive application assembly is used to seal the tail of a rolled product against the rolled product. After being positioned in a location upon a roller, the rolled product is rotated and a sensor detects the location of the tail end, thereby establishing a reference for determining tail length in later operations. When the tail reaches a desired position, the adhesive application assembly applies adhesive to the tail and/or rolled product. In some embodiments, the adhesive assembly includes one or more adhesive sprayers with aperture members, and is self-cleaning. After the adhesive has been applied, the tail is wound upon the rolled product. In some embodiments, an adhesive application assembly is employed to apply adhesive to a core about which sheet material is to be wound.

34 Claims, 20 Drawing Sheets

U.S. PATENT DOCUMENTS 2,755,768 A 7/1956 Olson
3,044,532 A 7/1962 Ghisoni
3,107,873 A 10/1963 Greding
3,113,884 A 12/1963 Kohler
3,134,706 A 5/1964 Alexander
3,172,612 A 3/1965 Besserdich
3,179,348 A 4/1965 Nystrand et al.
3,393,105 A 7/1968 Tellier, Jr.
3,415,221 A 12/1968 Stenger
3,511,693 A 5/1970 Davidson
3,532,572 A 10/1970 Herman
3,532,573 A 10/1970 Herman
3,553,055 A 1/1971 Janik
3,554,641 A 1/1971 Jeffee et al.
3,789,794 A 2/1974 Smith et al.
3,926,299 A 12/1975 Bradley et al.
3,935,057 A 1/1976 Gray
3,963,223 A 6/1976 Eysn
4,026,752 A 5/1977 Hartbauer et al.
4,102,304 A 7/1978 Debenham
4,103,840 A 8/1978 Dowd
4,133,495 A 1/1979 Dowd
4,151,314 A 4/1979 Debenham
4,163,180 A 7/1979 Dowd
4,177,410 A 12/1979 Dowd
4,244,767 A 1/1981 Hoeboer
RE30,598 E 5/1981 Spencer
4,299,642 A 11/1981 Berkholtz
4,327,877 A 5/1982 Perini
4,328,931 A 5/1982 Bullock, Jr. et al.
4,366,018 A 12/1982 Gross
4,456,190 A 6/1984 Karttunen et al.
4,475,974 A 10/1984 Perini
4,487,377 A 12/1984 Perini
4,516,735 A 5/1985 Snygg
4,552,316 A 11/1985 Dropczynski et al.
4,581,083 A 4/1986 Schutz et al.
4,586,645 A 5/1986 Harada
4,609,421 A 9/1986 Yui
4,693,223 A 9/1987 Eshleman et al.
4,693,766 A 9/1987 Stauffer
4,695,482 A 9/1987 Weiswurm
4,708,629 A 11/1987 Kasamatsu
4,791,879 A 12/1988 Eklund et al.
4,883,233 A 11/1989 Saukkonen et al.
4,909,452 A 3/1990 Hertel et al.
4,931,130 A 6/1990 Biagiotti
4,938,835 A 7/1990 Ludwig
4,962,897 A 10/1990 Bradley
4,963,223 A 10/1990 Biagotti
5,023,820 A 6/1991 Baum
5,033,403 A 7/1991 Mladota
5,040,738 A 8/1991 Biagiotti
5,137,225 A 8/1992 Biagiotti
5,169,447 A 12/1992 Jonovic et al.
5,199,991 A 4/1993 Chance
5,242,525 A 9/1993 Biagiotti
5,259,910 A 11/1993 Biagiotti
5,267,703 A 12/1993 Biagiotti
5,315,907 A 5/1994 Biagiotti
5,421,536 A 6/1995 Hertel et al.
5,474,646 A 12/1995 Matteucci
5,478,430 A 12/1995 Marchetti
5,542,622 A 8/1996 Biagiotti
5,571,564 A 11/1996 Helms et al.
5,573,615 A 11/1996 Vigneau et al.
5,575,612 A 11/1996 Uno
5,577,685 A 11/1996 Junk
5,639,046 A 6/1997 Biagiotti
5,643,398 A 7/1997 Lumberg
5,679,206 A 10/1997 Glass
5,681,421 A 10/1997 Biagiotti
5,690,296 A 11/1997 Biagiotti
RE35,729 E 2/1998 Biagiotti
5,716,489 A 2/1998 Biagiotti
5,759,326 A 6/1998 Vigneau
5,769,352 A 6/1998 Biagiotti
5,800,652 A 9/1998 Vigneau
5,839,680 A 11/1998 Biagiotti
5,853,140 A 12/1998 Biagiotti
5,979,818 A 11/1999 Perini et al.
6,050,519 A 4/2000 Biagiotti
6,143,111 A 11/2000 Biagiotti
RE37,039 E 2/2001 Biagiotti
6,276,587 B1 8/2001 Borresen et al.
6,372,064 B1 * 4/2002 Butterworth et al. ..... 156/64
6,378,799 B1 4/2002 Gambini
6,682,623 B1 * 1/2004 Biagiotti ..... 156/187

FOREIGN PATENT DOCUMENTS

EP 1136199 9/2001
GB 326043 3/1930
GB 1434941 5/1976
GB 1495445 12/1977
GB 1497662 1/1978
GB 2098092 11/1982
GB 2158371 12/1988
JP 5035562 11/1975
JP 59143837 8/1984
JP 62264154 11/1987
JP 1150666 6/1989
WO WO 8700091 1/1987
WO WO 9400298 1/1994
WO WO 9427901 3/1995
WO WO 9942393 8/1999
WO WO 9719876 1/2001
WO WO 0127389 4/2001
WO WO 0140575 6/2001
WO WO 0160729 8/2001
WO WO 0172620 10/2001
WO WO 0162454 1/2003
WO WO 0162635 1/2003
WO WO 0164563 1/2003

OTHER PUBLICATIONS

Chapman, Website page, http://www.chapman–static.com/home.html, Mar. 5, 2003.

Chapman, Website pages (3), http://www.chapman–static.com/ecs30.html, Mar. 5, 2003.

Chapman, Website pages (4), http://www.chapman–static.com/ecs200.html, Mar. 5, 2003.

L.G. Eriksson, C. Lydig and J.A. Viglund, Measurement of Paper Roll Density During Winding, Tappi Journal, Jan. 1983, vol. 88, No. 1, Technical Assoc. of the Pulp and Fiber Industry, Inc, Atlanta, GA, USA.

* cited by examiner

APPARATUS AND METHOD FOR APPLYING ADHESIVE IN A WEB CONVERTING MACHINE

CROSS-REFERENCE TO RELATED APPLICATIONS

This is a continuation-in-part of U.S. patent application Ser. No. 09/459,517 filed on Dec. 13, 1999 now 6,372,064, the entire disclosure of which is incorporated herein by reference.

FIELD OF THE INVENTION

The present invention relates to apparatus and methods for web converting machinery, and more particularly to apparatuses and methods for applying adhesive in web converting machinery.

BACKGROUND OF THE INVENTION

An important objective of most paper converting machinery is to quickly and efficiently produce packaged web product at low cost. For example, machines that operate to attach a sheet of material to a core for winding the material upon the core must perform this operation quickly and consistently for acceptance in the marketplace. As another example, machines that operate to complete a roll of wound product by attaching the tail of the product to the roll must also perform this operation quickly and consistently for acceptance in the marketplace. However, the demand for higher productivity from machines that perform such web rewinding operations has generated significant challenges in machine design.

With reference again to tail sealing operations, there exists a number of well-known ways in which the tail end can be secured or "sealed" (e.g., by gluing, moistening, etc.) to a log. Each such manner of tail sealing requires some manipulation of the tail end for correct alignment in glue application, proper rewinding, etc. Preferably, the tail of a product log is laid flat and unwrinkled against the log, with the tail being secured to the log at a position a short distance from the end of the tail. This tail sealing arrangement leaves a small length of the end of the tail unsecured to enable the end user to grasp, unseal, and unwind the rolled product. Improper tail end manipulation during the tail sealing process can lead to a number of undesirable results, including inconsistent tail end length and wrinkles in the sealed tail.

Other design challenges involve the application of adhesive to a core, log, or log tail in order to attach a sheet of material to a core or to attach a tail to a log. Although many different devices exist for applying adhesive to sheet product, logs, and cores, conventional adhesive applicators are often inefficient, messy, and require frequent cleaning and maintenance of the adhesive applicator and other equipment exposed to adhesive from the adhesive applicator. Adhesive rollers, brushes, and other applicators are commonly used, but are often slow, take up precious space in sheet rewinding and manipulating machines, and offer little control over the amount of adhesive applied. Although adhesive sprayers offer a number of advantages over rollers, brushes, and other adhesive applicators (including speed and relatively small size), they have not been widely accepted for applying adhesive due to mess from overspray and lack of spray control. As a result of these problems, the design of adhesive applicators in conventional sheet product manipulating apparatuses remains relatively simple and crude at the expense of speed and efficiency.

The foregoing and following discussion concerning the sheet rewinding industry is particularly relevant to paper rewinding. Accordingly, the problems and solutions described below are presented by way of illustration in the context of paper rewinding operations, such as rewinding operations on tissue paper, toilet paper, paper toweling, and the like. However, the present invention is not limited to paper rewinding or even to the paper industry. The present invention finds applicability in any operation in which rolled material is manipulated and/or wound. As such, reference in the present application and appended claims to "logs" of material include rolled product made of any material, such as paper, plastic, rubber, metal, composites, fabric, and the like. Also, the rolled product referred to herein and in the appended claims as product in "sheet" or "web" form can be of any shape and size, including material in sheet, strip, laminate, multi-ply or other form.

A number of conventional adhesive applicator methods and systems exist in the art. However, in order to limit the spread of adhesive in conventional sheet rewinding and manipulating devices, a number of adhesive applicators and applicator designs are not employed. As a result, many current adhesive applicator methods and systems are somewhat crude, providing little control over the amount and placement of adhesive on a tail, log, or core, generating inconsistent adhesive application results, and producing unreliable bonds.

Similarly, a number of conventional tail sealer methods and systems exist in the art. Several of these methods and systems are designed to avoid the aforementioned undesirable results of improper tail manipulation while maintaining a high rate of product output (i.e., sealed logs per minute). However, conventional tail sealers are usually quite complex, employing expensive systems and subsystems to separate and orient a measured length of the tail of each roll in a precise manner, apply adhesive to the tail or log in a precise location, and seal the tail on the log without wrinkling. Four examples of such conventional tail sealers are disclosed in U.S. Pat. No. 5,242,525 issued to Biagiotti, U.S. Pat. No. 4,475,974 issued to Perini, U.S. Pat. No. 3,393,105 issued to C. W. Teller, Jr., and U.S. Pat. No. 5,716,489 issued to Biagiotti. The teachings of the above-listed patents are incorporated herein by reference insofar as they relate to mechanisms and assemblies for manipulating tails of product rolls or logs. Due to their complexity, such conventional systems are invariably expensive and difficult to maintain. Also, an important limitation common to virtually all conventional systems is the maximum speed at which the systems can operate. In modern systems where a fraction of a second in each rewinding operation can significantly impact output and productivity, conventional tail sealing systems typically operate adequately at low speeds but display considerable inefficiencies when run to their highest speeds. The above-mentioned system complexity and bottlenecks caused thereby are often the cause of these inefficiencies. Additionally, such systems are generally less than precise and reliable in their sealing operations, particularly when run at higher speeds.

In light of the problems and limitations of the prior art described above, a need exists for an apparatus and method which can cleanly and reliably apply adhesive to a core, log tail, and/or log in a clean and precise manner, can reliably seal rolled products at a high rate, can produce a consistent and controllable length of tails sealed to the logs, can generate sealed tails which have few to no wrinkles, and can do so by employing a simplified system design which lowers system and maintenance cost. Each embodiment of the present invention achieves one of more of these results.

SUMMARY OF THE INVENTION

Some embodiments of the present invention provide an apparatus and method by which adhesive can be applied to a tail of a log of wound product and/or to the log product itself in order to attach the tail to the log. In other embodiments, this apparatus and method is employed to apply adhesive to a core in order to attach sheet product to the core for subsequent winding. The present invention also provides an apparatus and method by which tails of rolled products can be controlled during tail sealing operations of the rolled products.

To quickly accomplish tail sealing operations while maintaining sufficient control of a tail during tail sealing, some preferred embodiments of the present invention include a rotary indexer assembly for controllably feeding rolled products into the tail sealer system, an upper conveyor assembly which rolls the rolled products through the tail sealer system, a lower conveyor assembly which rolls each rolled product within the tail sealer system to unroll the tail to a glue applying position and indexes the proper tail length of each rolled product, an adhesive assembly for applying adhesive to each tail and/or to each rolled product, and an ironing roller assembly which ensures contact between the tail and the rolled product for permitting the adhesive to bond the tail to the rolled product.

In accordance with a preferred method of the present invention, a product roll (or "log") is indexed into the tail sealer system by the indexer assembly. After being indexed, the log is held and preferably rotated in place between the lower conveyor assembly and the upper conveyor assembly. A roll in the lower conveyor assembly is preferably provided to rotate the log in this manner as one or more air jets blow the tail against the roll. In doing so, the length of the tail is preferably measured by a sensor while the roll is precisely indexed.

When the desired tail length has been detected or measured, one or more sprayers spray adhesive upon the unrolled tail and/or upon the log itself. The lower conveyor assembly and the upper conveyor assembly then preferably reverse directions to wind the tail back upon the log. Preferably, the surface speeds of the lower and upper conveyor assemblies are matched during this rewinding operation to keep the roll in place between the lower and upper conveyor assemblies until the tail is fully rewound upon the log. Alternatively, the speeds can be selected to move the log to a roll surface while the tail is being rewound. By gradually being rewound on the log as the log is rotated, the tail of the log is quickly rewound and sealed without wrinkles.

The sealed log is then rolled to the ironing roller assembly for sealing the tail to the log and is finally ejected from the tail sealer system. Preferably, the orientation of the sealed log (the position of the sealed tail upon the log) is known and/or controllable to eject each sealed log from the tail sealer system in a uniform orientation. The orientation of the sealed log is preferably controlled by adjusting the speed and/or the number of rotations of the roller assembly, the conveyor assembly or both assemblies.

In some preferred embodiments of the present invention, an adhesive application assembly having at least one adhesive sprayer and an apertured member is employed to deposit adhesive upon the sheet product. The apertured member is positioned or positionable adjacent to the adhesive application position and has an aperture substantially aligned with the spray trajectory of adhesive from the adhesive sprayers. The apertured member therefore operates as a stencil to permit only a desired pattern of adhesive to pass through the aperture and onto the sheet product in the adhesive application position. This creates an accurate pattern (preferably a line) of adhesive upon the sheet product, does so with less adhesive waste, and generates no appreciable overspray exiting into upstream or downstream equipment.

Some preferred embodiments of the present invention employ an adhesive application assembly that is self-cleaning. Specifically, the apertured member is preferably movable with respect to a cleaning element to bring the apertured member into and out of contact with the cleaning element. Most preferably, the cleaning element is a rotating brush rubbing the apertured member to clean adhesive therefrom. The rotating brush is preferably positioned or positionable within cleaning fluid to assist in the cleaning process. The cleaning element can be movable toward and away from a substantially stationary apertured member, can be substantially stationary and be contacted by a movable apertured member, or can move with the apertured member to contact and clean the apertured member. Other embodiments of the present invention employ cleaning sprayers to spray cleaning fluid upon the movable or substantially stationary apertured member or upon the cleaning element. Among other advantages of the self-cleaning adhesive application assembly, this assembly lowers maintenance costs associated with the equipment in which it is installed and results in better adhesive applicating results over longer periods of time.

As alternatives to using adhesive sprayers in the adhesive application assembly, other adhesive application devices can apply adhesive in conventional manners. For example, an adhesive dip wire, adhesive fountain tip, or one or multiple adhesive applicator roll assemblies can contact the core in the core path to deposit adhesive thereon. In such cases as well as in the preferred embodiment described above, proper product alignment ensures good adhesive application. Such alignment can be provided by sensors and various other measuring devices.

In still other embodiments of the present invention, the adhesive application assembly described above is employed to apply adhesive to cores prior to winding sheet material thereon. The advantages of employing such an adhesive application assembly in preparing cores for winding are similar to those described above for tail sealing.

To help prevent adhesive from exiting the adhesive application position adjacent to the adhesive application assembly and to prevent drafts, dust and other foreign matter from affecting the adhesive application process, some embodiments of the present invention include a dust guard shielding the product in the adhesive application position. Preferably, the dust guard is movable from its shielding position to a retracted position. More preferably, the dust guard is movable to its retracted position in response to movement of the core or sheet product away from the adhesive application position following adhesive application.

More information and a better understanding of the present invention may be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

Figure 1:
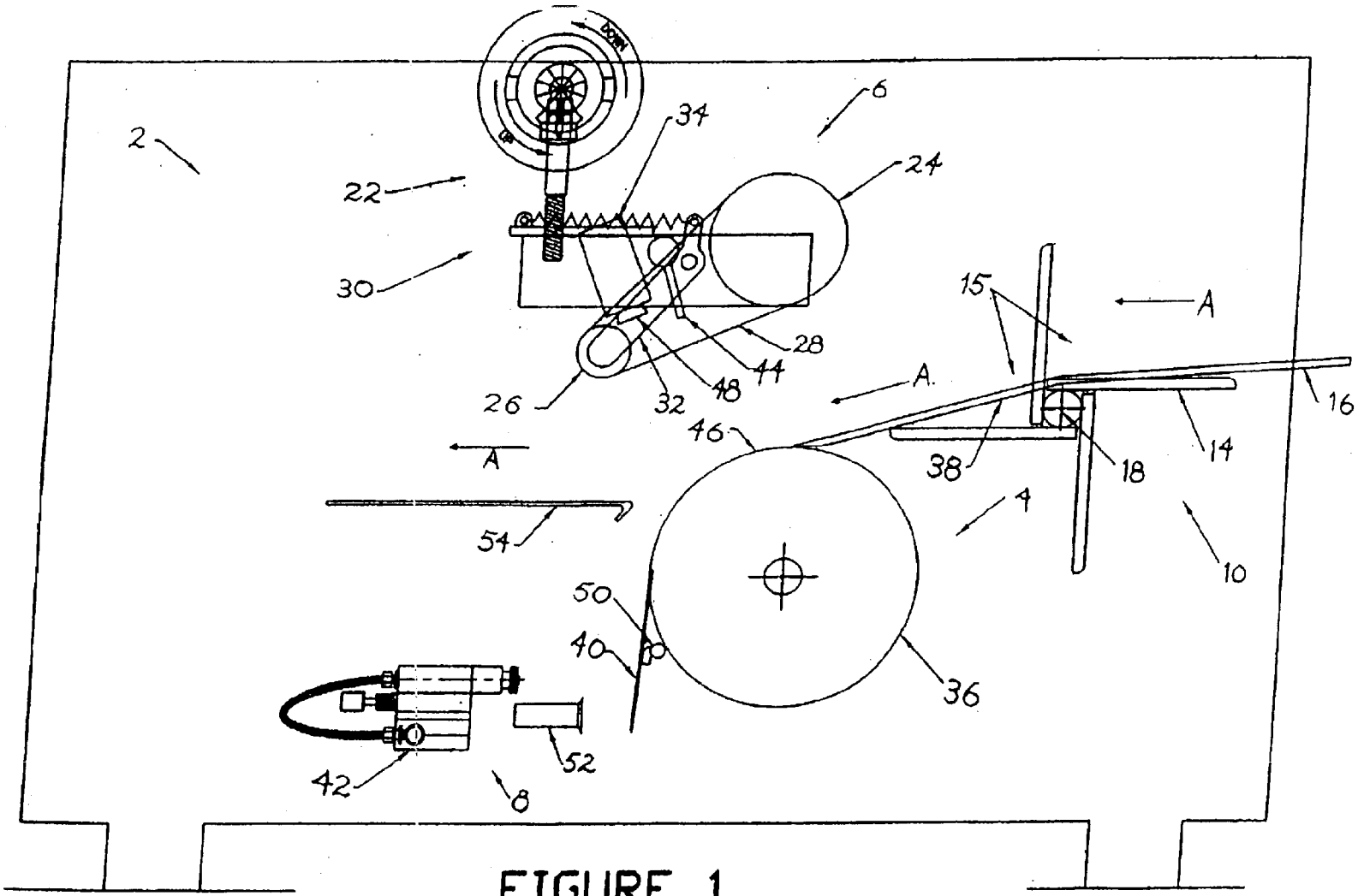
FIG. 1 is an elevational view of the tail sealer apparatus according to a first preferred embodiment of the present invention.

A preferred embodiment of a tail sealer system according to the present invention is illustrated in FIG. 1. The path of logs through the tail sealer system 2 is indicated by the arrows A in FIG. 1. The tail sealer system 2 preferably includes three subsystems: a lower conveyor assembly 4, an upper conveyor assembly 6, and an adhesive assembly 8. Preferably, the tail sealer system 2 also includes a rotary indexer assembly 10. Each assembly is discussed below in greater detail.

The rotary indexer assembly 10 is of a type well known in the art, and includes a rotary indexer 14 preferably having four product stations 15 sized to accommodate and hold a log introduced down an intake ramp 16 and into the tail sealer system 2. The rotary indexer 14 is preferably rotatably suspended by an indexer shaft or pivot 18 at the end of the intake ramp 16 which leads logs into the tail sealer system 2. Rotation of the rotary indexer 14 is controlled by a conventional indexer motor or servo motor (not shown) in a manner discussed more fully below.

The term "log" as used herein and in the appended claims denotes a rolled product of any type, such as toilet paper, paper towels, other paper products, fabrics, foils, synthetic sheeting, and any other material which can be wound or rolled about an axis. The term "log" as used herein does not carry with it any inherent or inferred limitation on the final shape or size of the final wound or rolled product.

Preferably, both the lower conveyor assembly 4 and the upper conveyor assembly 6 are adjustably secured in position with respect to one another. In order to accommodate various roll sizes, the upper conveyor assembly 6 is preferably adjustably secured in place by an adjustment assembly 22, which permits the vertical location of the upper conveyor assembly 6 to be changed and set. The adjustment assembly 22 can take a number of forms well-known to those skilled in the art, such as a crank wheel engaging a threaded rod for lifting or lowering a frame attached to the upper conveyor assembly 6, a hydraulic cylinder connected to an upper conveyor assembly frame or directly to the nip or tension roller 24, 26 (described below) and which can be actuated to raise or lower the upper conveyor assembly 6, etc. Such adjustment assemblies are conventional in nature and are therefore not further described herein. However, it should be noted that the adjustment assembly 22 can be controlled manually or automatically (e.g., via an actuator, solenoid, etc.) in manners which are also well-known in the art. Also, although the embodiment shown in the figures discloses an adjustment assembly adjustable in the vertical direction, it will be appreciated by those skilled in the art that the adjustment assembly 22 can instead be adjustable in the horizontal direction or in both the vertical and horizontal directions in order to change the orientation of the upper conveyor assembly 6 with respect to the lower conveyor assembly 4, the adhesive assembly 8, and/or the ironing roller assembly in alternate embodiments of the present invention.

The upper conveyor assembly 6 preferably includes a roller 24 and a tension roller 26 around which a belt 28 runs. Although the tension roller 26 can be made non-adjustable, the upper conveyor assembly 6 can also be provided with a tensioning mechanism 30 which is used to adjust tension of the belt 28. Specifically, the tension roller 26 is preferably mounted for rotation to a tension arm 32 itself connected to the upper conveyor assembly 6 in a conventional manner (not shown). Preferably, a spring 34 is attached at an end of the tension arm 32 opposite the tension roller 26 and maintains a desired pivoting tension upon the tension arm 32, thereby pushing the tension roller 26 against the belt 28 to maintain a desired tension of the belt 28. The manner in which tension of the spring 34 is adjusted and maintained, and the elements, arrangement, and configuration of the tensioning mechanism 30 are well-known in the art and are therefore not described in greater detail herein. One having ordinary skill in the art will appreciate that a number of other elements and assemblies can be used to maintain a tension force against the tension roller 26 (such as by a coil, leaf, or other spring attached to the upper conveyor assembly 6 and exerting the force upon the tension roller 26, a conventional actuator mounted between the tension roller 26 and the upper conveyor assembly 6, etc.). Such other elements and assemblies and their operation are also well-known to those skilled in the art.

The lower conveyor assembly 4 preferably has a roller 36 rotatably mounted in a conventional fashion at the end of a ramp 38 leading from the rotary indexer assembly 10. The roller 36 is preferably driven by a servo-controlled motor or by any other conventional system capable of rotating the roller 36 in both directions and precisely positioning the roller 36 in various rotational positions. Such conventional drive systems are well-known to those skilled in the art and are not therefore described in greater detail herein.

For purposes which will be described in more detail below, the lower conveyor assembly 4 also preferably has a tail support 40 extending downwardly from the roller 36. The tail support 40 can take a number of forms, such as a plate or series of rigid or substantially rigid members mounted with respect to the roller 36, but preferably is a number of fingers extending downwardly from the surface of the roller 36. In some highly preferred embodiments, the tail support 40 is defined by a series of conveyors extending from the roller 36 to a position away from the roller 36. These conveyors can take any conventional form, and in some cases are belt conveyors having one end adjacent to the roller 36 and having another end located a distance from the roller 36 (see, for example, the embodiment of the present invention shown in FIGS. 11–13).

When a tail of a log is rotated from the surface of the roller 36 to and across or along the tail support 40 (see below), a smooth transition from the roller surface to the tail support 40 is preferably provided. Accordingly, some highly preferred embodiments of the roller 36 have longitudinally-spaced grooves in the roller 36 into which the tail support 40 extends so that a tail moving from the roller 36 to the tail support 40 does so smoothly. For example, in those embodiments in which the tail support 40 is defined by two or more conveyor belts as described above, the ends of the conveyor belts adjacent to the roller 36 can be recessed within circumferential grooves in the roller 36 so that sheet product rotating with the roller 36 can be readily transferred to the conveyor belts for movement away from the roller 36.

Tail supports 40 in the form of conveyors are highly desirable for their ability to convey sheet product in a wrinkle-free manner away from the roller 36. Any number of such conveyors 40 can be employed as desired.

In some embodiments, the adhesive assembly 8 includes a series of sprayers 42 mounted beside the lower conveyor assembly 4 (only one of which is visible in the figures). Most preferably, the series of sprayers 42 extend along substantially the entire length of the lower conveyor assembly 4 and are adapted to spray a line of adhesive upon a log's tail in the adhesive application position as will be described in more detail below. However, the adhesive assembly 8 can instead have as few as one sprayer 42 performing the same operation and spraying a fan of adhesive to deposit the line of adhesive upon the tail. The sprayer(s) 42 can deposit any desired pattern of adhesive upon the tail, including without limitation one or more lines (either arranged in series or in parallel form), dots, or other adhesive patterns. Though not preferred, it is even possible to mount one or more sprayers 42 beside the lower conveyor assembly 4 for longitudinal movement via a track, guide, rail or like element along the lower conveyor assembly. In this manner, adhesive can be sprayed in a line or other pattern across the tail when the tail is in its adhesive application position and/or while the tail is moved to or from the adhesive application position. To ensure a straight longitudinal line of adhesive when the sprayer(s) 42 spray while the tail is moving, the sprayer(s) 42 can be mounted for simultaneous horizontal and vertical movement along the lower conveyor assembly 4 (e.g., the track, guide, rail or like element can be diagonally disposed relative to the lower conveyor assembly 4, can be manually or automatically adjustable relative to the lower conveyor assembly 4, etc.).

Each sprayer 42 is preferably connected in a conventional fashion to a source of adhesive (not shown). The source of adhesive can be a pressurized tank of adhesive or can be a reservoir from which the adhesive is pumped and then pressurized for spraying. The sprayers 42 and their manner of connection to a source of adhesive are conventional in nature and are therefore not described further herein. A number of conventional liquid adhesives exist which are suitable for sealing the tail of a log against the log. By way of example only, such adhesives can include a starch and/or sugar and water mixture, conventional adhesive bonding material, and in some cases can just be water (depending at least partially upon the manner in which the sheet material to be attached or sealed reacts to exposure to water). As used herein and in the appended claims, the term "adhesive" therefore refers to any adhesive material that can be used to attach sheet material to itself (and in the core adhesive spraying embodiments described below, to a core), including without limitation glue, epoxy, and any other adhesive or cohesive bonding material. Such adhesives are well-known in the art and can be used with any of the tail sealer embodiments disclosed herein.

Figure 16:
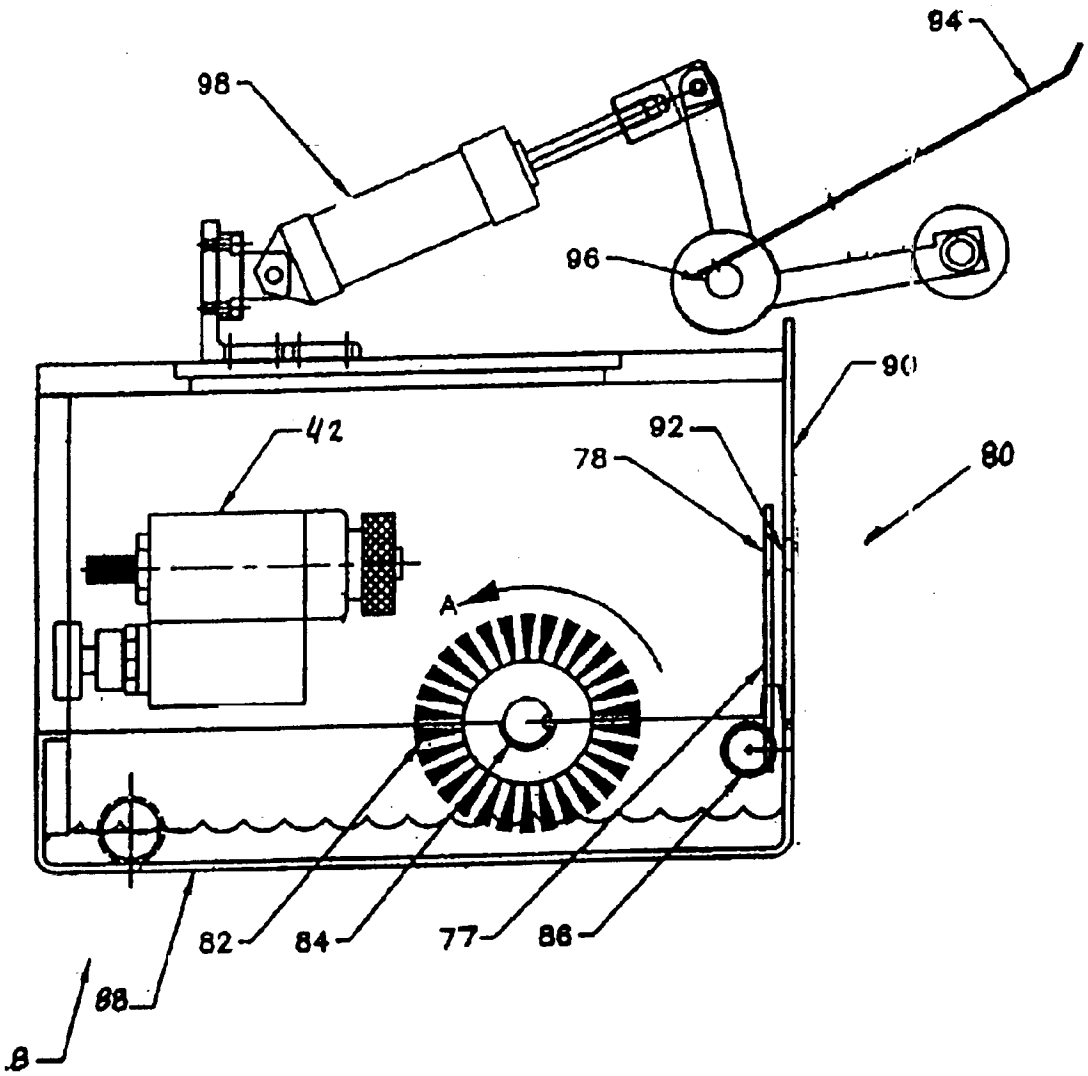
FIG. 16 is an elevational view of an adhesive application assembly according to a preferred embodiment of the present invention, shown in a state ready to apply adhesive.
Figure 17:
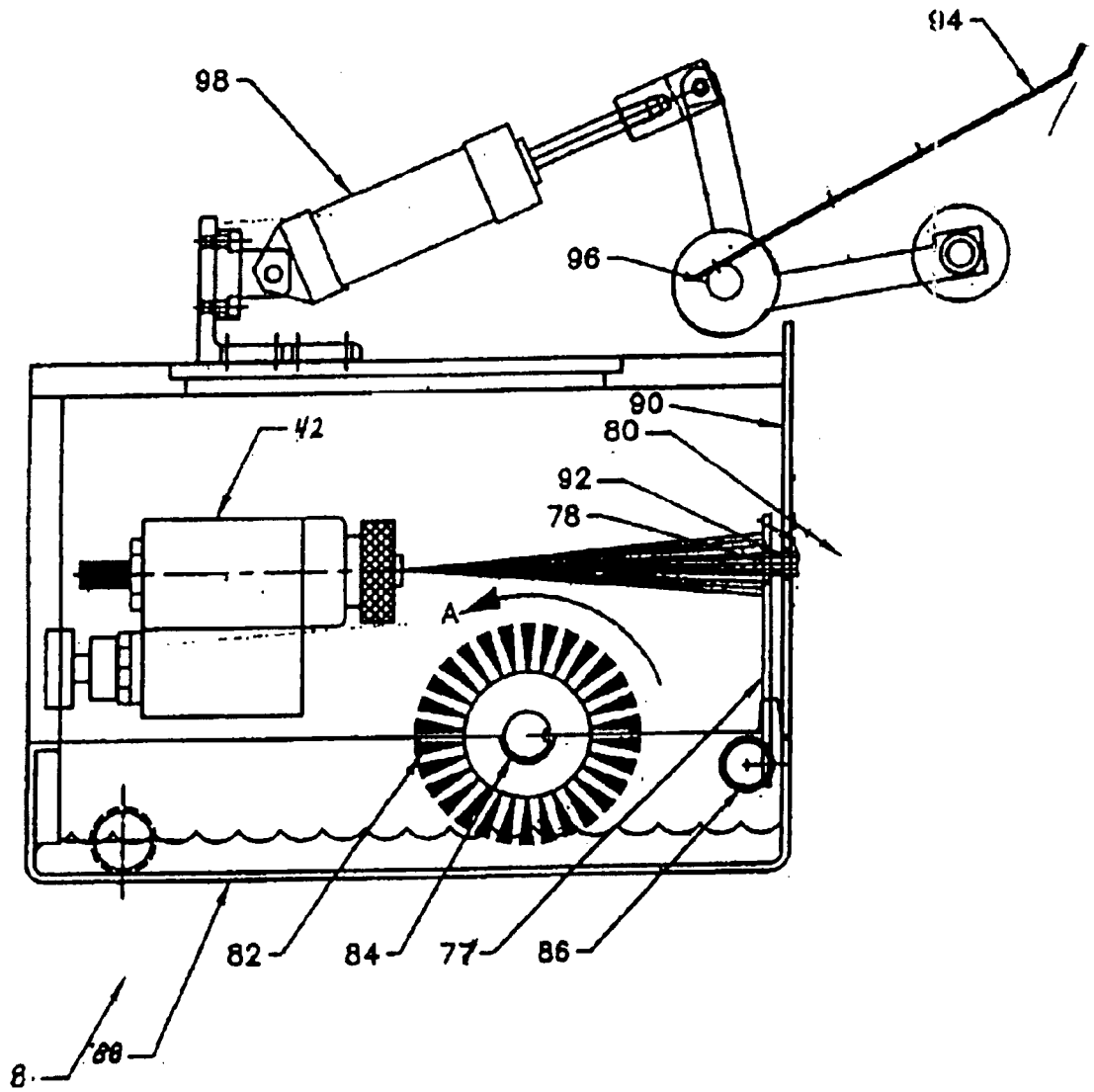
FIG. 17 is an elevational view of the adhesive application assembly of FIG. 16, shown in the process of applying adhesive.
Figure 18:
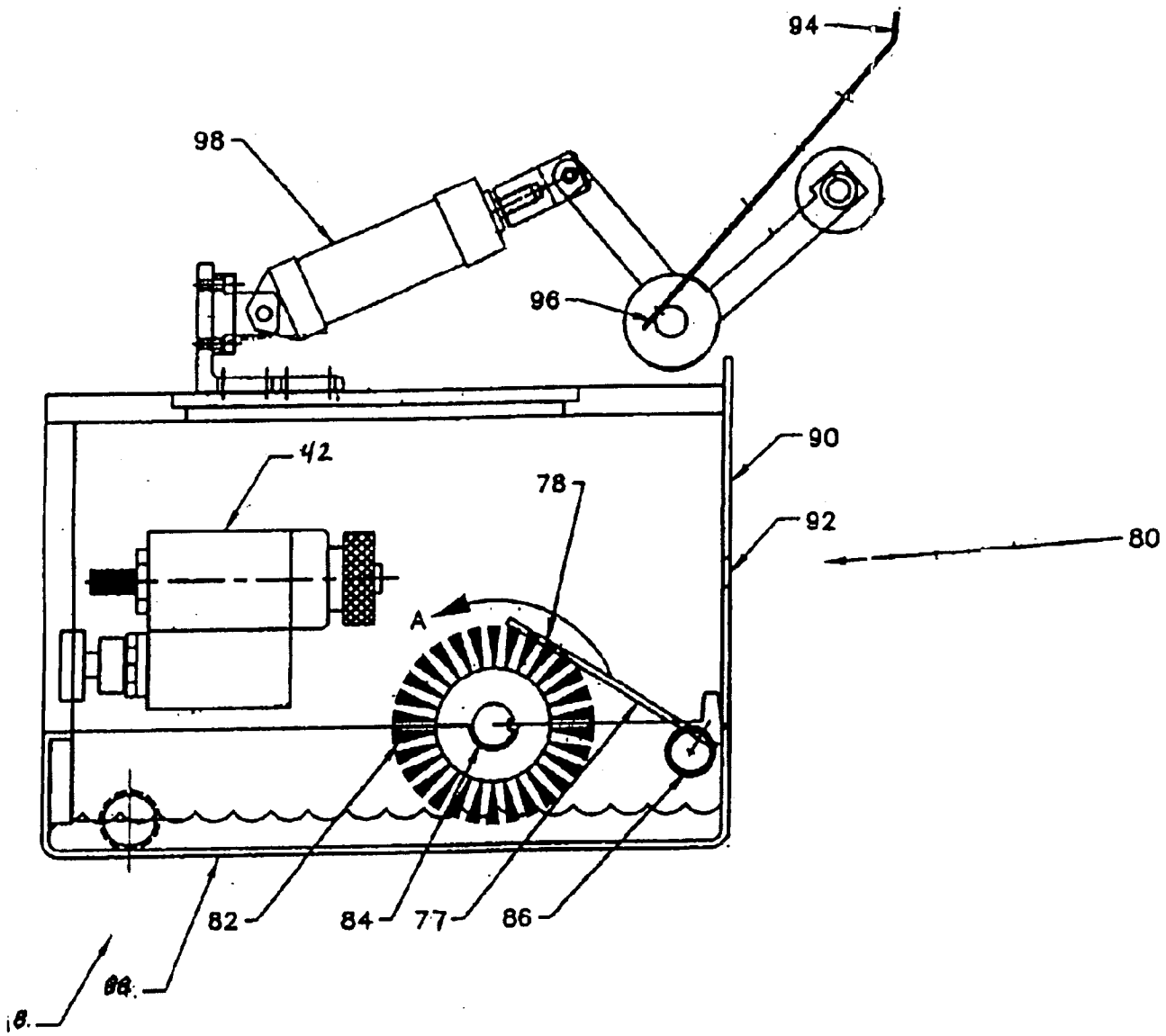
FIG. 18 is an elevational view of the adhesive application assembly of FIGS. 15 and 16, shown in the process of self-cleaning.

The adhesive application assembly 8 illustrated in the preferred embodiment of FIGS. 1–10 is shown in greater detail in FIGS. 16–18. In this embodiment, the adhesive application assembly 8 is at least partially enclosed within a tank 88, and includes at least one adhesive sprayer 42 connected to a source of adhesive under pressure (not shown) and an aperture member 77 having an aperture 78 therethrough. The adhesive sprayers 42 are conventional in form and operation, and are preferably (although not necessarily) airless to reduce air currents causing overspray. In order to improve adhesive applicating precision, each adhesive sprayer 42 preferably has a nozzle projecting adhesive in a band or line rather than in a spot. However, other nozzle spray patterns well known to those skilled in the art can instead be used, if desired.

In some embodiments such as that shown in FIGS. 16–19, the aperture 78 of the aperture member 77 is positioned or positionable in the line of trajectory of the adhesive sprayers 42 between the sprayers 42 and an adhesive application position 80 outside of the tank 88. Preferably, the aperture member 77 is positioned or positionable adjacent to the adhesive application position 80, and more preferably closely adjacent to the adhesive application position 80.

Tails of logs L brought to the adhesive application position 80 are aligned with the trajectory of the adhesive sprayers 42 and with the aperture 78 in the aperture member 77. When the adhesive sprayers 42 sprays adhesive, the aperture member 77 acts as a stencil to produce a desired pattern of adhesive upon the tail in the adhesive application position 80 behind the aperture member 77. By using the aperture member 77 to apply adhesive to tails in this manner, a better defined shape from sprayed adhesive can be created on the tails with minimal overspray (for obvious reasons, overspray and adhesive circulating in the interior of the tail sealer system 2 is very undesirable). Better defined adhesive shapes reduce adhesive waste and improve tail sealing operations. The aperture member 77 can be any shape capable of performing the stenciling function just described, and is most preferably a plate, bar, screen, or series of plates or bars extending substantially the entire length of the lower conveyor assembly 4.

Because the tails run in the tail sealing system 2 shown in FIGS. 1–10 are typically elongated in shape, adhesive is preferably deposited along the length of the log tail. Many different types of adhesive patterns can be used, including without limitation a series of adhesive dots or patches, a continuous or broken longitudinal stripe, and the like. A continuous longitudinal stripe is most preferred, so the aperture 78 in the aperture member 77 is most preferably in the form of an elongated slit running substantially the entire length of the lower conveyor assembly 4.

In order to use as few adhesive sprayers 42 as possible in the adhesive application assembly 8, the adhesive sprayers 42 are preferably located a distance from the aperture member 77 and the adhesive application position 80. The distance is preferably long enough to permit the adhesive sprayers 42 to be separated from one other as far as possible while still providing overlapping spray patterns (to create a continuous adhesive strip) and while keeping the adhesive sprayed around the aperture 78 of the aperture member 77 below a desired overspray level. Without the aperture member 77, the adhesive spray reaching the log's tail from sprayers 42 spaced in such a manner would be deposited in a generally poorly defined elliptical shape. With the aperture member 77 located as described above however, the adhesive deposited preferably has a much more defined linear shape or at least has a relatively thin elliptical shape. Therefore, the aperture member 77 described above permits fewer adhesive sprayers 42 to be used, increases adhesive application precision, and can conserve adhesive.

It will be appreciated that the overspray on the aperture member 77 can build up over time and can eventually interfere with adhesive passing through the aperture 78 in the aperture member 77. To prevent this from happening, some embodiments of the adhesive application assembly 8 are self-cleaning. In such embodiments, the aperture member 77 is preferably occasionally cleaned by a cleaning element to remove adhesive buildup on the aperture member 77. In some highly preferred embodiments of the present invention, the cleaning element is one or more brushes 82 mounted upon a brush pivot 84 rotatably driven in a conventional manner. To clean the aperture member 77 with the brushes 82, the aperture member 77 is preferably also mounted for rotation upon a pivot 86. The pivot 86 can be moved between a position in which the aperture 78 of the aperture member 77 is in the line of trajectory of the adhesive sprayers 42 and a cleaning position in which the aperture member 77 contacts and is rubbed by the brushes 82. A conventional pneumatic actuator (not shown) connected to the pivot 86 and controlled in a conventional manner is preferably used to reciprocate the aperture member 77. However, any other driving device (including without limitation hydraulic and magnetic actuators, electric motors, and the like) can instead be used as desired.

With continued reference to the adhesive applicator assembly illustrated in FIGS. 16–18, the rotating brushes 82 are preferably located partly within cleaning fluid at the bottom of the tank 88. Depending upon the type of adhesive being used, the cleaning fluid can be a solvent, a detergent or other cleanser, or even water. By rotating when the aperture member 77 is in contact therewith, the brushes 82 rotate wet bristles into rubbing contact with the aperture member 77 and continue to rotate the bristles into the cleaning fluid to wash the bristles and to collect cleaning fluid for the next rotation. Rather than dip bristles into a cleaning fluid at the bottom of the tank 88 (or in addition thereto), one or more cleaning fluid sprayers can be directed toward the brushes 82 to wet the bristles and to spray off adhesive therefrom.

As an alternative to the pivotable aperture member 77, the aperture member 77 can be mounted in a stationary fashion within the tank 88 and the brush pivot 84 can be mounted for translation to move the brushes 82 toward and away from the aperture member 77. In such an arrangement, translation of the brush pivot 84 can be performed in a number of ways well known to those skilled in the art, such as by rotating wheels to which the ends of the brush pivot 84 are attached, by swinging the brushes 82 about one or more pivot arms, by translating the ends of the brush pivot 84 through tracks in a conventional manner, and the like. In each case, the brushes 82 are preferably temporarily brought into rubbing contact with the aperture member 77 between sprays from the adhesive sprayer 42 and are then moved away either to be dipped and rotated in a reservoir of cleaning fluid or sprayed with cleaning fluid as mentioned above. As yet another alternative, both the aperture member 77 and the rotating brushes 82 can be moved together in manners described above to clean the aperture member 77.

Although a pivotable aperture member 77 (or pivotable rotating brushes 82) is preferred to clean the aperture member 77, one having ordinary skill in the art will appreciate that either of these elements can be moved in a number of different ways to bring them into rubbing contact with one another. By way of example only, the aperture member 77 can be mounted to pivot about a point to thereby swing into contact with the rotating brushes 82. As another example, the aperture member 77 can be pivoted about a pivot extending from the front wall 90 of the tank 88 (thereby pivoting about a circle extending into and out of the plane of FIGS. 16–18). The brush pivot 84 can be mounted for rotation adjacent to the front wall 90 so that when the aperture member 77 is pivoted, the aperture member 77 comes into rubbing contact with the rotating brushes 82. Other manners of bringing the aperture member 77 and the rotating brushes 82 into rubbing contact with one another are possible and fall within the spirit and scope of the present invention, The movements of the aperture member 77 and rotating brushes 82 need not be reciprocating as in the preferred embodiment described above and illustrated in the figures. Instead, depending at least in part upon the arrangement of elements in the tank 88 and space constraints therein, either element can be mounted for straight or curved reciprocation or rotation as desired.

A number of alternatives exist to the use of rotating brushes 82 to clean the aperture member 84. For example, the aperture member 77 can be cleaned by one or more brushes, pads, sponges, or other elements mounted for reciprocation in a conventional manner and (optionally) for movement toward and away from the aperture member 77 as discussed above, by one or more sprayers directing cleaning fluid toward the aperture member 77 either in its position shown in FIGS. 16 and 17 or in a position such as that shown in FIG. 18, and the like. It is even possible to emit pressurized cleaning fluid from the adhesive sprayers 42 by control of one or more valves supplying adhesive and cleaning fluid to the sprayers 42. Valves and their control of multiple fluid types supplied to sprayers are well known to those skilled in the art and are not therefore described further herein. If desired, multiple cleaning elements of the same or different type can be used in the adhesive application assembly 8, such as to clean both sides of the aperture member 77, to simultaneously rub and spray the aperture member 77, and the like.

Especially where the adhesive sprayers 42 are used to emit cleaning fluid, but also where other cleaning fluid sprayers are used or where cleaning fluid spray occurs as a result of cleaning element movement, a shutter (not shown) can be mounted to selectively cover or uncover the spray aperture 92 in the front wall 90 of the tank 88 during cleaning. The shutter position can be changed in any conventional manner, such as by one or more conventional electronic, pneumatic, or hydraulic actuators, solenoids, magnets, and the like coupled to a system controller (also not shown) capable of controlling the shutter in a well known manner.

Although a tank 88 is not required to practice the present invention, the tank 88 is preferably used to contain adhesive and cleaning fluid within the tail sealer system 2, and therefore preferably substantially encloses the adhesive sprayers 42, the cleaning elements (e.g., rotating brushes 82), and the aperture member 77. At a minimum, the tank 88 preferably has walls that keep adhesive and cleaning fluid from spraying into other areas of the tail sealer system 2. If spray and splash is kept well under control during tail sealer operation, then the tank 88 is "substantially enclosed" for the purposes of spray and splash prevention even though it has no top, no back, and/or has reduced side walls. In this regard, the term "tank" is understood to refer to any set of walls or elements preventing adhesive and cleaning fluid spray from exiting the adhesive application assembly 8. In more preferred embodiments, the tank 88 encloses the adhesive sprayers 42, cleaning elements 82, and aperture member 77 on all sides to prevent dust and contaminants from entering the tank, fouling the cleaning fluid, clogging the sprayer nozzles, and collecting on tank surfaces covered by adhesive. Also, exposure of the elements inside the adhesive application assembly to air currents and drafts can misdirect adhesive spray and lead to poor adhesive application. Therefore, except for necessary electrical, fluid, and mechanical connections to the adhesive sprayers 42, cleaning elements 82, and aperture member 77, each of these elements are preferably fully enclosed within the tank 88. However, in other embodiments, any of these elements can be located at least partially outside of the tank 88 (such as the cleaning elements 82 or aperture member 77 movable to positions outside of the tank 88, the adhesive sprayers 42 mounted outside of the tank 88 and directing adhesive fluid inside the tank 88, etc.).

It should be noted that in some embodiments of the present invention, the aperture member 77 itself is part of the tank 88. Specifically, the front wall 90 of the tank 88 in such embodiments is removed, and the aperture member 77 acts not only as a stencil but also as a wall to keep adhesive and cleaning fluid in the adhesive application assembly 8.

Figure 19:
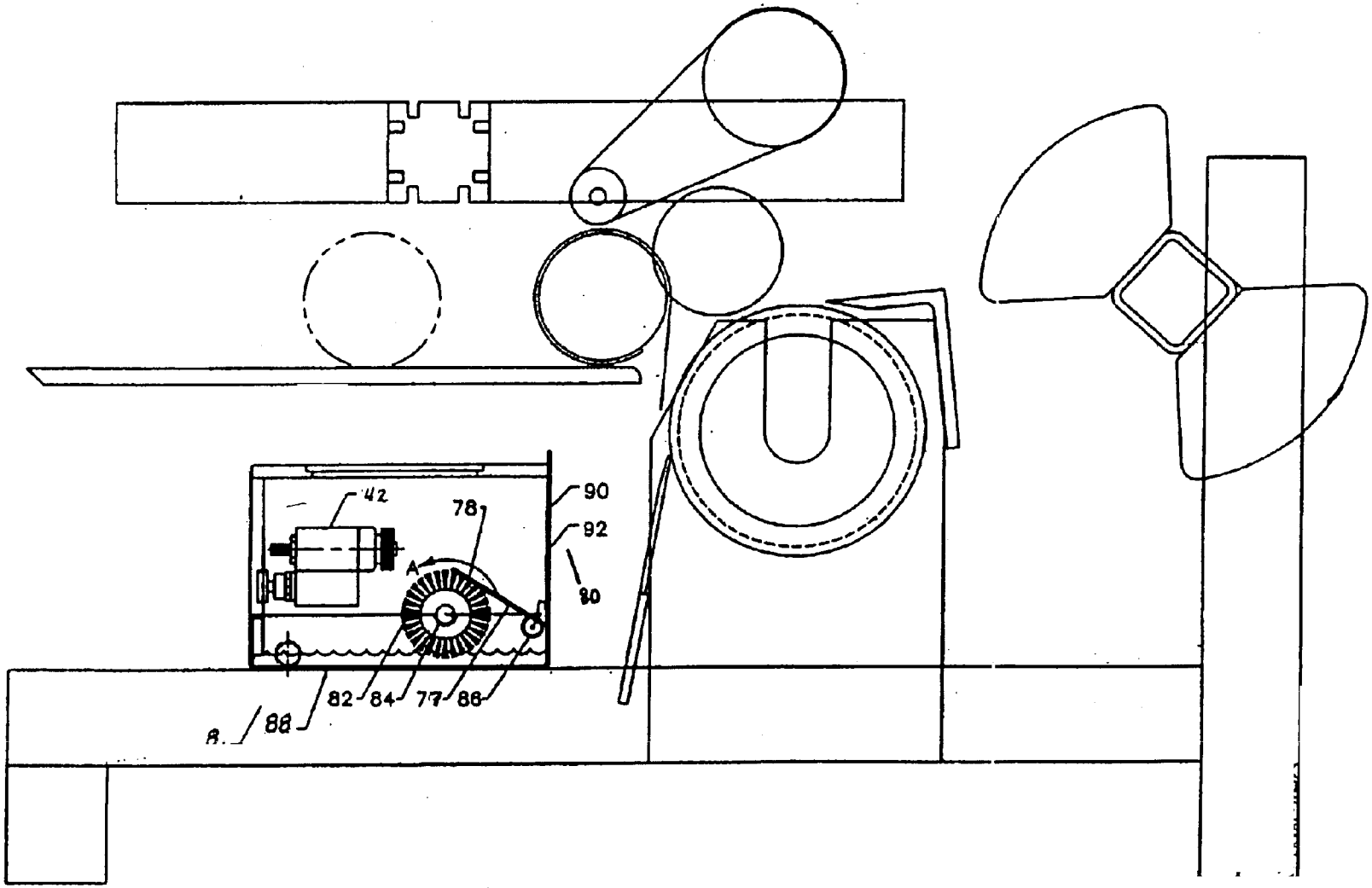
FIG. 19 is an elevational view of a tail sealer apparatus and adhesive application assembly according to a preferred embodiment of the present invention.
Figure 20:
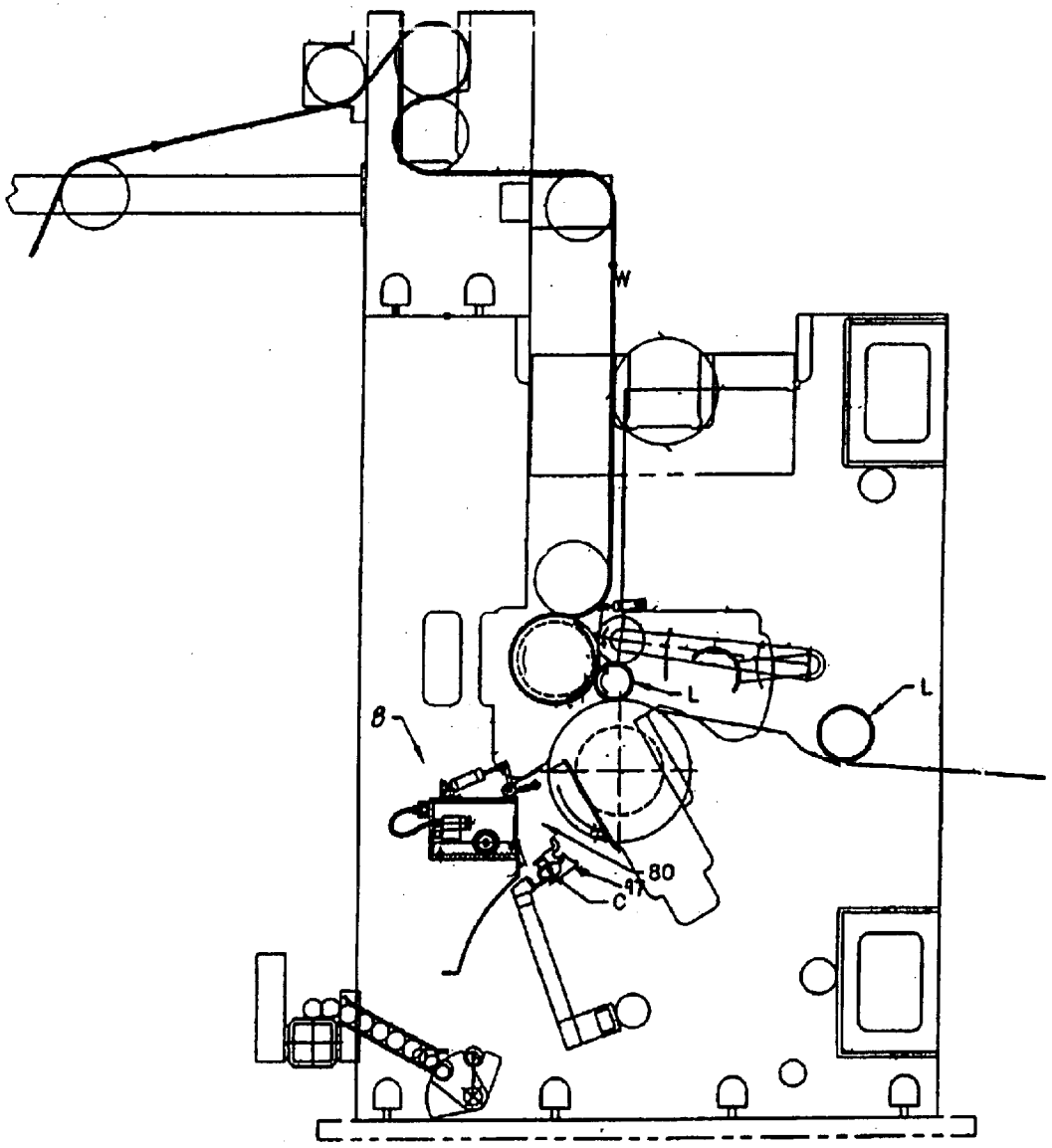
FIG. 20 is an elevational view of a rewinder apparatus and adhesive application assembly according to a preferred embodiment of the present invention.

The adhesive application assembly 8 of FIGS. 16–18 is described above for application in a tail sealing apparatus such as that shown in FIG. 19. Specifically, the adhesive application assembly 8 can be used to apply adhesive upon the tails of wound logs of web material after rewinding. However, the adhesive application assembly of the present invention is not limited to such use. In particular, the same structure and elements described above and illustrated in the figures can be used to spray adhesive upon cores upon which web material is to be wound. For example, the adhesive application assembly 8 of the present invention can be mounted within a rewinder to apply adhesive upon cores entering a winding nip of the rewinder (see FIG. 20). Many of the problems associated with log tail sealing are substantially the same as those in the application of adhesive to cores. As such, the adhesive application assembly 8 can be used to spray adhesive directly upon the cores or upon the web (which is then wound in a conventional manner). Rewinder construction and operation is well known to those skilled in the art. Examples of rewinders and their operation are provided in U.S. Pat. Nos. 5,772,149, 5,820,064, and 6,000,657 issued on Jun. 30, 1998, Oct. 13, 1998, and Dec. 14, 1999, respectively to Tad T. Butterworth, the disclosures of which are incorporated herein by reference insofar as they relate to web rewinder construction and operation.

Whether used to apply adhesive to cores for web winding thereon or to apply adhesive to tails and/or logs for tail sealing, the orientation of the adhesive application assembly 8 shown in the figures can be significantly different. The adhesive sprayers 42 can be directed in virtually any direction. Therefore, the adhesive application assembly 8 can be used to spray adhesive directly upon the tails of passing logs, upon the logs themselves, upon the cores, or upon any part of a web. Additionally, the cleaning fluid and the cleaning element 82 within the tank 88 (if used) can be located differently with respect to the adhesive sprayers 42 and the aperture member 77. In such cases, the aperture member 77 is still preferably mounted to move (and more preferably, to rotate about a pivot) from a position in front of the adhesive sprayers 42 to a position contacting the cleaning element 82. Alternatively, the aperture member 77 can remain stationary while the cleaning element 82 moves toward and away from the aperture member 77 (and more preferably, into and out of cleaning fluid in the tank 88 or before cleaning sprayers in the tank 88). In each orientation of the adhesive sprayers 42 and tank 88, a number of aperture member positions and cleaning element positions in the tank 88 are possible to accomplish the functions described above, and would be recognized by one having ordinary skill in the art.

Operation of the First Preferred Embodiment

With reference to FIGS. 2–10, the operation of the first preferred embodiment of the present invention will now be discussed.

Figure 2:
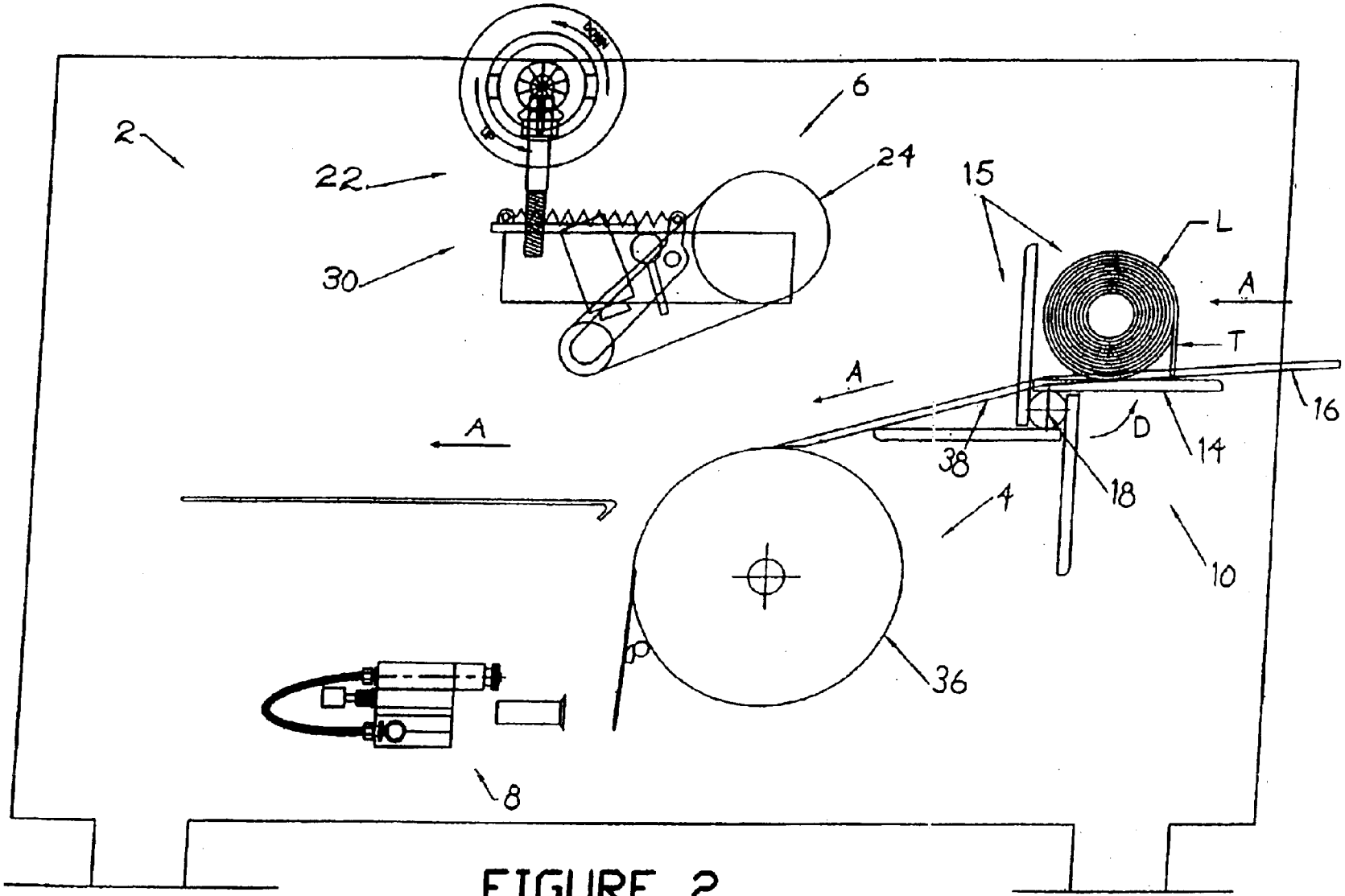
FIG. 2 is an elevational view of the tail sealer of FIG. 1, showing an unsealed log in the rotary indexer.

In FIG. 2, a log L is shown within the rotary indexer 14 of the rotary indexing assembly 10, having rolled down the intake ramp 16 into one of the rotary indexer's four product stations 15. At this stage, the tail T of the log L is not secured to the log L. Next, and at an appropriate time (discussed below) preferably controlled by a motor (not shown) which drives the indexer shaft 18, the rotary indexer 14 is turned about the indexer shaft 18 in a counter-counterclockwise manner indicated by the arrow D in FIG. 2. Eventually, the rotary indexer 14 is turned to such an extent that the log L rolls out of the product station 15 in the rotary indexer 14 and down the ramp 38 to a nip location between the roller 36 of the lower conveyor assembly 4 and the nip roller 24 of the upper conveyor assembly 6 (see FIG. 3).

At this stage, the belt 28 on the upper conveyor assembly 6 is turned by the turning the nip roller 24 in a conventional manner (e.g., by a motor, not shown). If desired, the tension roller 26 can also be driven by the motor or by a dedicated motor mounted in a conventional manner for movement with respect to the adjustable tension roller 26. Similarly at this stage, the roller 36 of the lower conveyor assembly 4 is turned in a conventional manner (e.g., also by a motor, not shown). The turning directions of the belt 28, the nip roller 24, the tension roller 26, and the roller 36 of the lower conveyor assembly 4 are indicated by the arrows E–H in FIG. 3. When the log L is in the nip position shown in FIG. 3, the log L is turned in place while the tail T is freed from the log L (if stuck thereto). Specifically, at this stage, the speed of the belt 28 and the surface speed of the nip roller 24 is equal or nearly equal to the surface speed of the lower conveyor assembly roller 36, thereby causing the log L to rotate in its translational position between the upper conveyor assembly 6 and the lower conveyor assembly 4, or to translate the log L only a relatively small amount. While the log L rotates, jets of air are directed from jets 44 toward the surface of the log L. Only one jet 44 is visible in the figures. It should be noted that rather than a series of in-line air jets 44 as preferred in the embodiment of the present invention shown in the figures, one or more blasts of air can be shot from a single jet having a slit-shaped nozzle positioned similarly to the air jets 44. Other conventional air jet shapes and orientations are possible, each achieving the same result of directing a stream or shot of air towards the surface of the log L to release the tail T from the surface of the log L as the log L rotates in the nip position.

Figure 3:
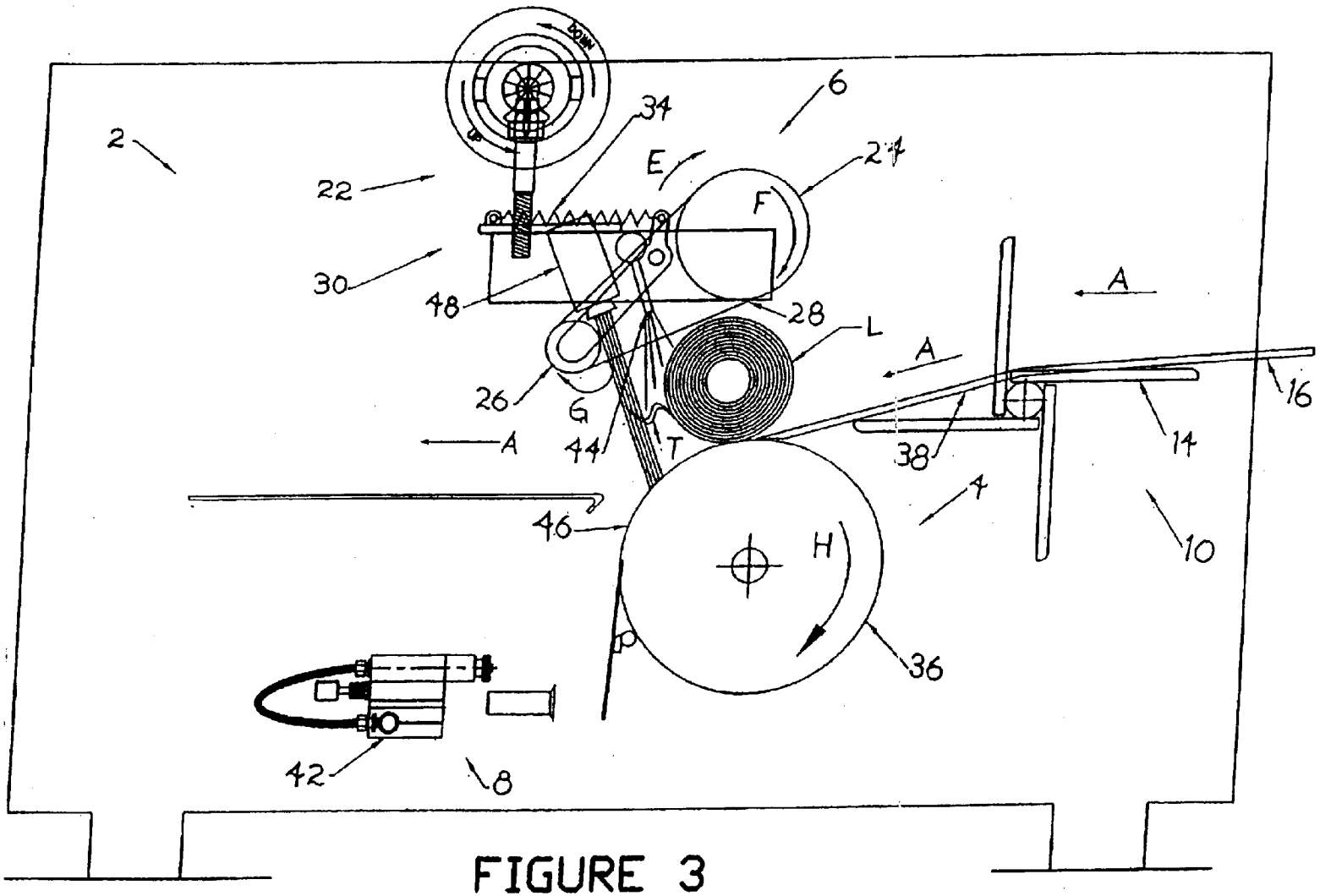
FIG. 3 is an elevational view of the tail sealer of FIGS. 1 and 2, showing the log in the nip position and showing the tail end of the log being blown down into position on a roll of the lower conveyor assembly and in front of the sensor.
Figure 4:
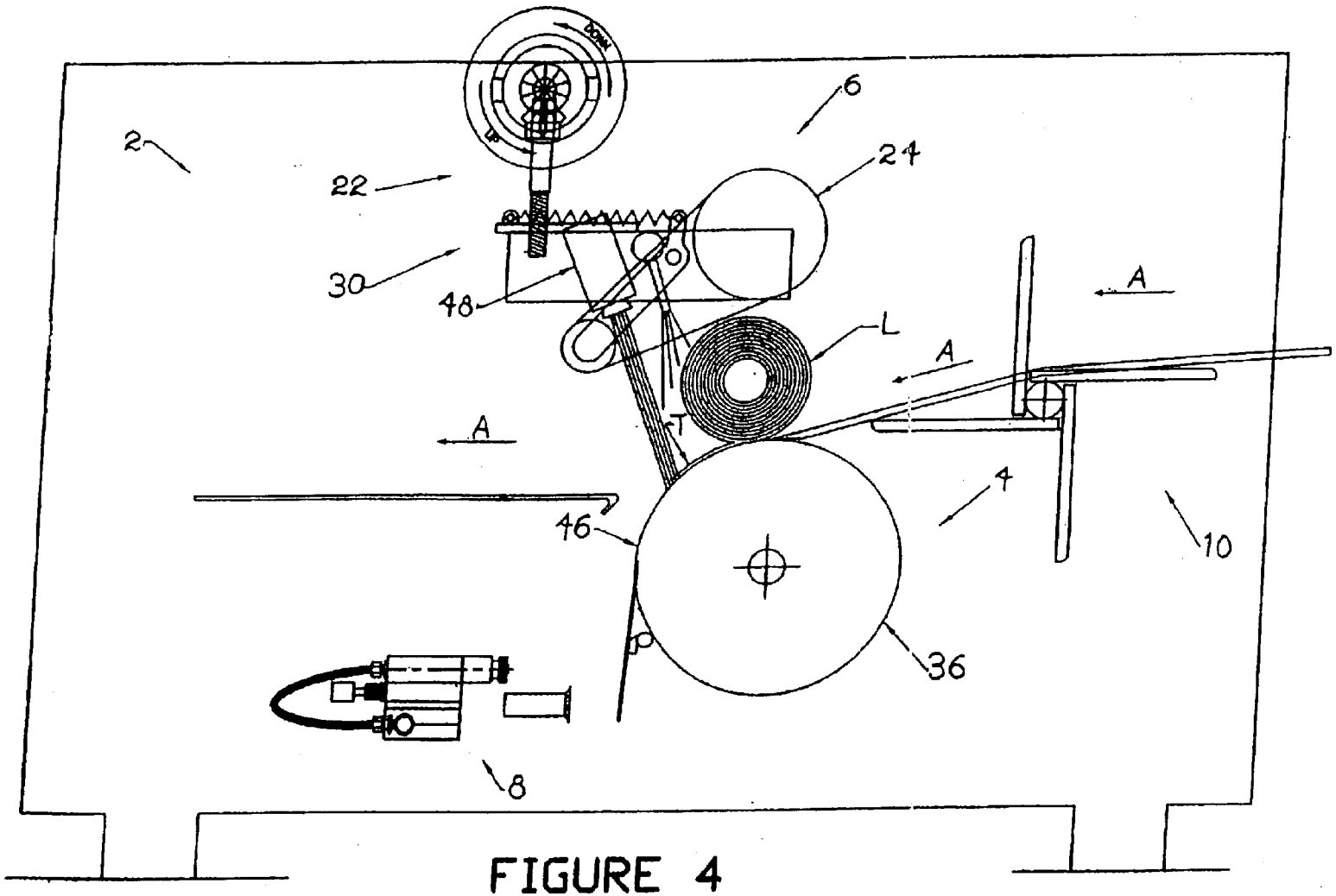
FIG. 4 is an elevational view of the tail sealer of FIGS. 1–3, showing the tail end of the log being drawn by the roll and monitored by the sensor to detect the end of the tail.

Also at the process stage shown in FIG. 3, at least a portion of the surface 46 of lower conveyor assembly roller 36 is continually monitored by a sensor 48 to detect the presence of the tail T and the location of the end of the tail T on the surface 46 of the roller 36. The sensor 48 is preferably mounted on or proximate the upper conveyor assembly 6, and monitors a segment of the roller surface 46 between the point at which the log L contacts the roller 36 and a point on the lower conveyor assembly 4 aligned with the line of fire of the sprayers 42. In other preferred embodiments, the sensor 48 is located within a groove, recess, or other aperture in the roller 36, and is positioned so that the tail T passes over the sensor 48 after being blown upon the roller 36. More details regarding this type of sensor placement will be presented below with regard to the illustrated preferred embodiment of FIGS. 11–13. Although the sensor 48 is preferably an optical sensor, other sensor types can also be used, such as infrared sensors or proximity sensors. Additionally, more than one sensor and sensor type can be used to detect the presence and end of the tail T.

After being blown off of the surface of the log L, the tail T is preferably held in place against the surface 46 of the lower conveyor assembly roller 36 by air emitted from jets 44. It should be noted that additional or different air jets (not shown) can be located around or proximate the upper conveyor assembly 6 to perform this function.

Figure 5:
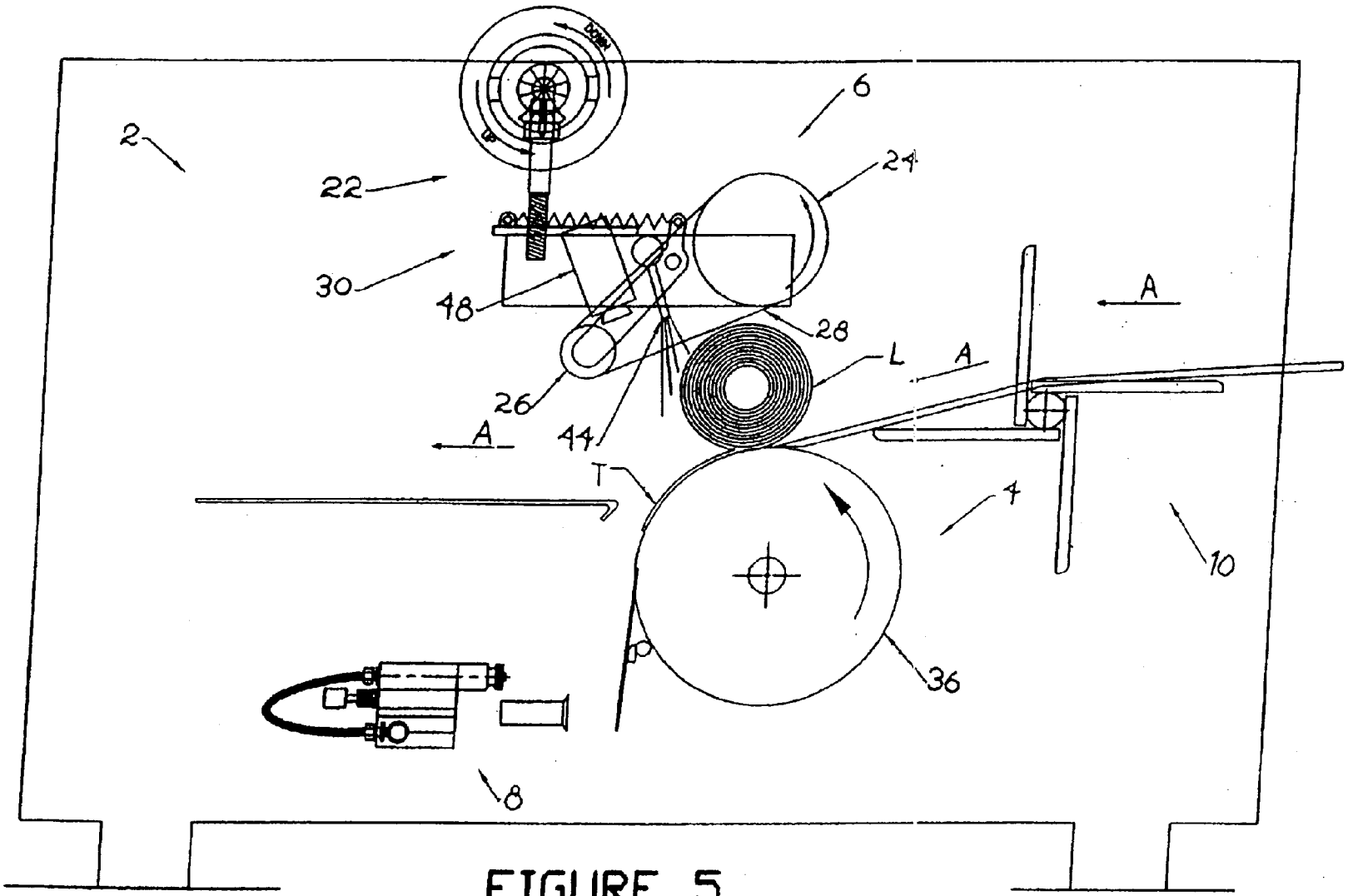
FIG. 5 is an elevational view of the tail sealer of FIGS. 1–4, showing the tail being unwound toward an adhesive applicating position.

The nip roller 24 and the roller 36 of the lower conveyor assembly 4 preferably continue to rotate in a controlled manner by their respective motors until the sensor 48 detects the end of the tail T by detecting the uncovered surface 46 of the roller 36 or by otherwise detecting the passage of the end of the tail T. See FIG. 4. At this point, a signal is sent from the sensor 48 to a conventional controller (not shown) which controls the rotation of the roller 36 and the nip roller 24 via their respective motors. Such controllers and their operation are well-known in the art, and are therefore not described further herein. Once the end of the tail T is detected by the sensor 48, the signal sent to the controller causes the controller to reverse the turning direction of the roller 36 and the nip roller 24 (from turning in clockwise directions to counter-clockwise directions as shown in FIG. 5). It should be noted that the location of the end of the tail T and the location of the log L in the nip position corresponds to angular positions of the lower conveyor assembly roller 36. As such, when the end of the tail T is detected by the sensor 48, the exact length of the tail T is known and certain (the circumferential length of the roll surface 46 between the angular positions just mentioned).

By reversing the rotational direction of the lower conveyor assembly roller 36 as described above, the counter-clockwise rotation of the belt 28 (by the nip roller 24) and the counter-clockwise rotation of the roller 36 causes the tail T to unwind from the log L. As also shown in FIG. 5, air is preferably emitted from the air jets 44 to maintain the tail T upon the roller 36 as the tail T is unwound. The constant air jet force against the tail T as it is unwound from the log L ensures that the tail T unwinds upon the roller 36 in a wrinkle-free manner. Preferably, the speed of the belt 28 and the surface speed of the nip roller 24 is equal to the surface speed of the lower conveyor assembly roller 36, thereby causing the log L to continue rotation in its translational position between the upper conveyor assembly 6 and the lower conveyor assembly 4. However, if movement from the nip position shown in FIG. 5 is desired, such as to move the log L further toward the tension roller 26 as the tail T is unwound, the amount by which the belt 28 moves and/or the amount by which the roller 36 rotates during the counter-clockwise rotation of the roller 36 and the nip roller 24 is preferably measured by the controller. This measurement can be made by conventional devices used to measure the amount of rotation of a motor, drive shaft, or driven unit. Therefore, by the time the tail T of the log L reaches an adhesive application position such as that shown in FIG. 6, the exact length of the tail T is preferably known.

Figure 6:
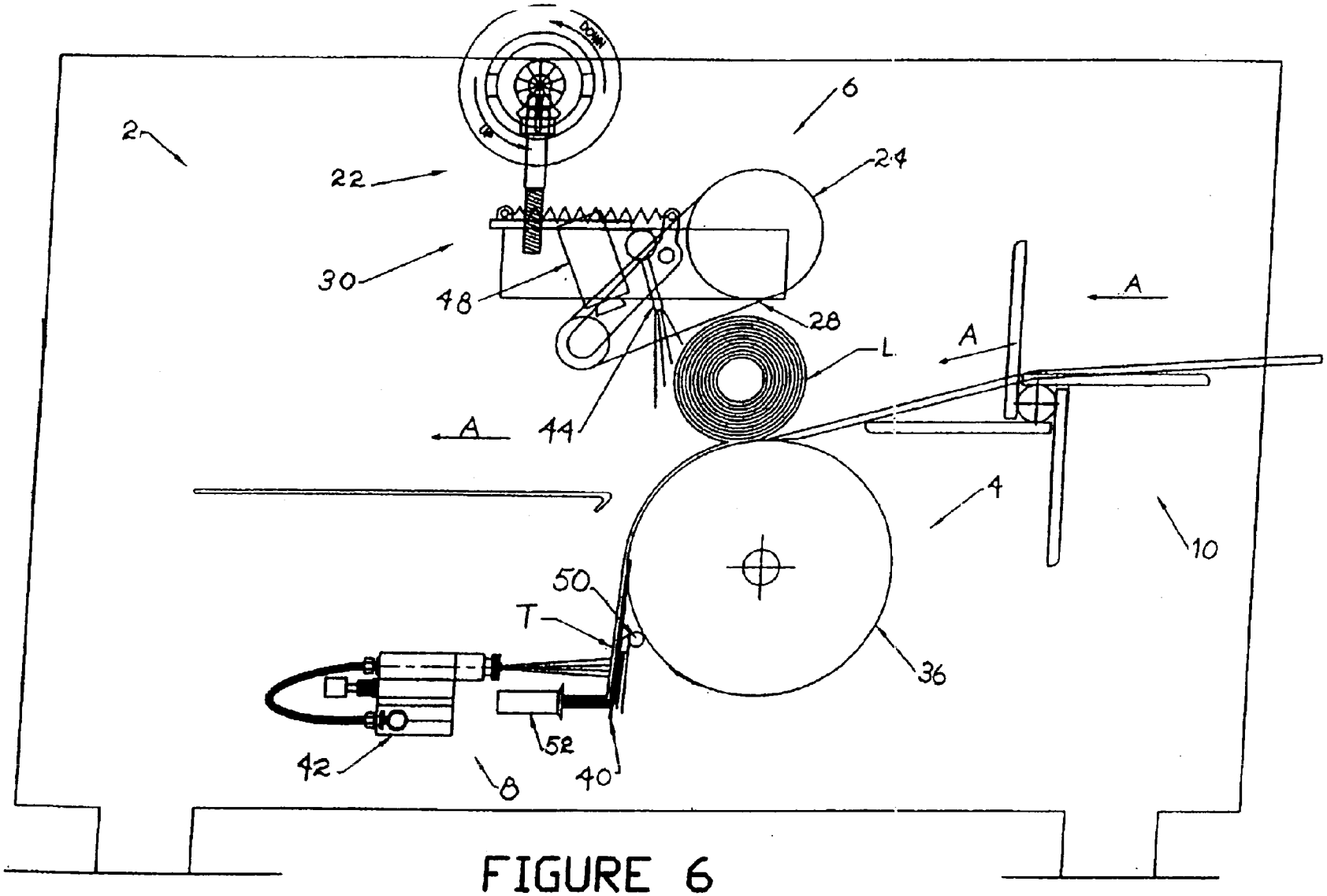
FIG. 6 is an elevational view of the tail sealer of FIGS. 1–5, showing the tail in the adhesive applicating position and the adhesive sprayers spraying adhesive on the tail.

As shown in FIG. 6, the tail is unwound sufficiently to pass over and down the fingers of the tail support 40 until it reaches an adhesive application position. To keep the tail T against the lower conveyor assembly roller 36 and the tail support 40, air continues to be emitted from the air jets 44 upon the tail T. Also, a series of tail support air jets 50 are preferably conventionally mounted beside and are directed downwardly along the tail support 40 in order to help guide the tail T down the tail support 40 and to keep the tail T taut and wrinkle free. Such air jets are conventional in nature and are not therefore described in greater detail herein. Embodiments of the present invention employing one or more conveyors (e.g., conveyor belts) for the tail support 40 can also assist in maintaining the tail T taut and wrinkle free by helping to draw the tail T along the tail support 40. In this regard, the conveyor-type tail support 40 can even be vacuum-assisted, such as a series of conventional vacuum belts holding the tail T as the tail T is drawn to an adhesive applicating position.

The location of the adhesive upon the tail T is important because it determines how much tail is left free upon the completed product for a consumer to grasp in unwinding a new roll. Too much free tail can lead to problems and jamming in downstream equipment and can detract from the appearance of the finished product. Too little free tail can result in a product which is difficult to unwind. Although a sensor is not necessary to control and adjust the amount of tail T unwound from the log L (and thereby to determine the location of adhesive application upon the tail T and the amount of free tail on the completed log L) as will be described in greater detail below, an applicator sensor 52 is employed in some embodiments to monitor unwound tail length.

Specifically, an applicator sensor 52 can be mounted adjacent to the tail support 40 and can be positioned to detect the location of the tail T upon the tail support 40 to reliably and consistently apply the adhesive to a desired location on the tail T. Like the sensor 48 used for detecting the end of the tail T in the tail unwinding stage illustrated in FIG. 4, the applicator sensor 52 is preferably an optical sensor, but other sensor types such as infrared and proximity sensors can also be used. In such embodiments, when the applicator sensor 52 detects the end of the tail T, it preferably sends a signal to trigger (either directly or via the system controller) the sprayers 42 to spray adhesive upon the tail T. As such, the location at which the end of the tail T is sensed is preferably a desired distance below the line of sight of the sprayers 42. The sensor, however, can be located on either side of the tail. For example, the sensor 52 can be located inside the lower conveyor assembly 4 or on a finger inside a groove of the roller 36 to help keep the sensor 52 free from adhesive spray.

In those embodiments of the present invention employing a sensor 52 to control adhesive application upon the tail T, one having ordinary skill in the art will appreciate that the distance between the adhesive location and the end of the tail T can be adjusted in several ways. In some embodiments, multiple applicator sensors 52 can be located down the tail support 40, each of which successively detects the presence of the tail T as it proceeds down the tail support 40. By selecting which applicator sensor 52 to trigger the sprayers 42 (via the controller), different distances between the adhesive location and the end of the tail T can be selected. Alternatively, it is possible to mount the applicator sensor 52 for translation alongside the path of the tail T on the tail support 40, such as by a conventional track, rail, or guide assembly, a chain and sprocket or cable and pulley assembly, and the like, each being driven in a conventional manner by a motor or other driving device and controlled manually or by the system controller. By moving the location of the applicator sensor 52 along the tail support 40, the point at which the sprayers 42 are triggered by the applicator sensor can be adjusted to change the distance between the adhesive location on the tail T and the end of the tail T. The location of adhesive upon the tail T can also be changed by moving the location of the adhesive sprayers 42 along the length of the tail support 40. For example, in the embodiment of the present invention shown in the figures, the sprayers 42 can be mounted for vertical movement and can be controlled in much the same manner as the location-adjustable applicator sensors 52 described above.

In some cases, it can be undesirable to employ a sensor for determining the length of the tail T and to thereby control the location of adhesive application upon the tail T. For example, adhesive overspray in some embodiments can cause problems with a sensor. Therefore, in some preferred embodiments of the present invention, the location of adhesive upon the tail T is determined by measuring the distance between the location of the log L and the end of the tail T. This measurement can be determined by measuring the amount of rotation of the roller 36 and/or the belt 28 to determine how much of the tail T has been unwound off of the log L. Devices capable of automatically measuring roll rotation and belt movement are well-known to those skilled in the art. With this information, the length of the tail unwound is known (the radii of the roller 36 and the nip roller 24 being already known). If desired, these measurement can be transmitted to the system controller for determining the length of the tail unwound. Because the distance between the log L and the line of sight of the sprayers 42 is also known, the length of tail T beyond the line of sight of the sprayers 42 is then found by subtracting the length of the tail T unwound. When the desired length is reached, the sprayers 42 can be triggered manually or by the controller to spray adhesive upon the tail T.

Several other devices and methods exist for changing the location of adhesive sprayed upon the tail T of the log L, each one of which either changes the location of the sprayer (s) or the sensor(s), enables different sensors to trigger the sprayers, monitors the tail length unwound, changes the location of the unwinding log L between the upper conveyor assembly 6 and the lower conveyor assembly 4 (i.e., speeds or slows the lower conveyor assembly roller 36, the nip roller 24, or both rollers), and/or directly measures or senses the length of the tail T unwound. Each of these devices and methods falls within the spirit and scope of the present invention.

Figure 7:
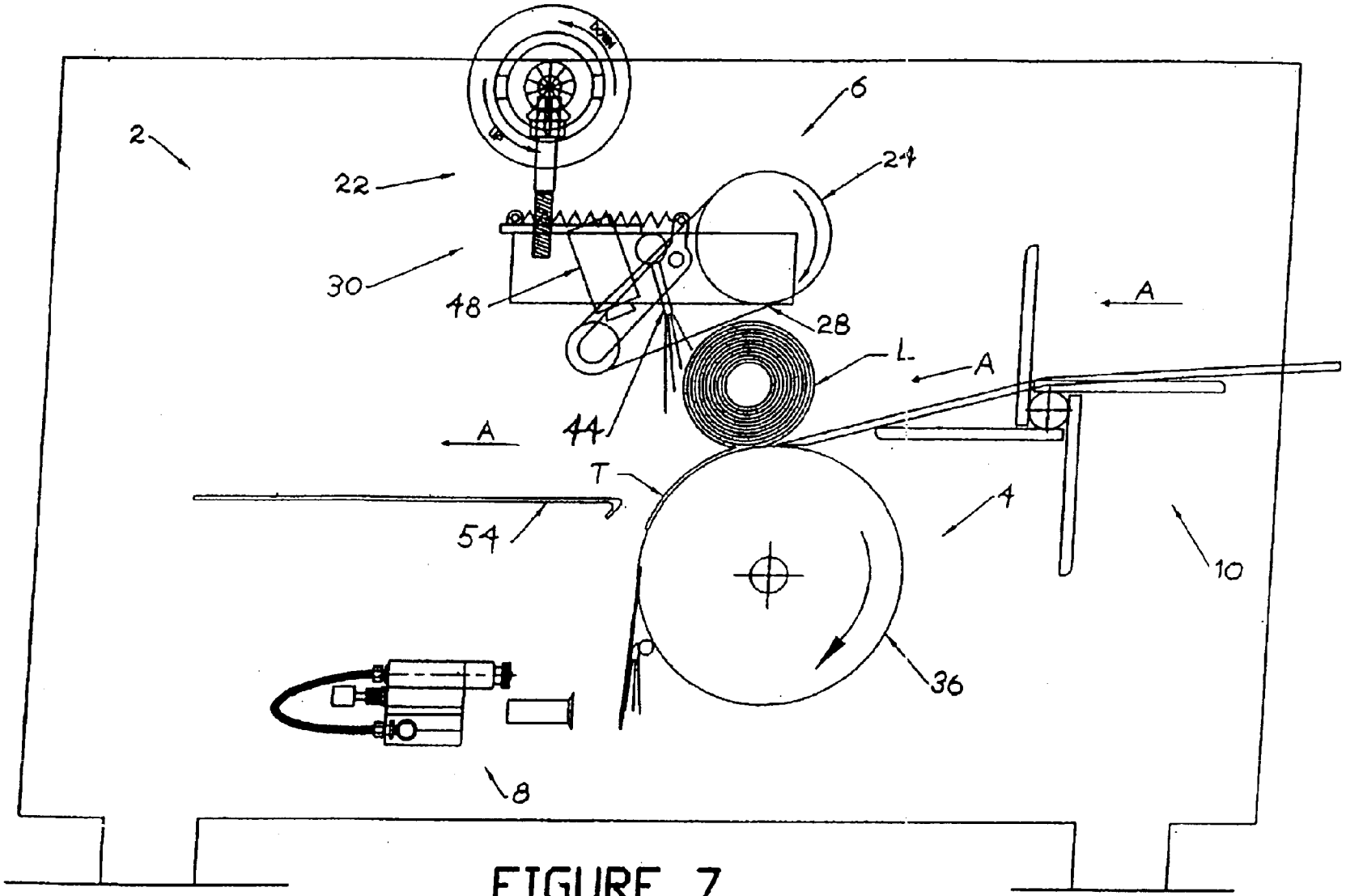
FIG. 7 is an elevational view of the tail sealer of FIGS. 1–6, showing the tail being rewound on the log by reversed rotation of the upper and lower conveyor assemblies.

After adhesive has been sprayed upon the tail T of the log L, the tail T is preferably wound back upon the log L. In those embodiments of the present invention employing a self-cleaning adhesive application assembly 8 such as that shown in FIGS. 16–18, the adhesive application assembly 8 can begin cleaning itself while the tail T is being wound back onto the log L. Preferably, the controller causes the drives driving the lower and upper conveyor assemblies 4, 6 to reverse, thereby winding the tail T upon the log L as shown in FIG. 7. Preferably, the lower and upper conveyor assemblies 4, 6 rotate in this manner at the same speed or substantially the same speed to cause the log L to roll in place as the tail T is wound (or to move the log L only slightly during this process). Meanwhile, the jets 44 preferably continue to blow jets of air upon the tail T to keep the tail T flat and smooth against the lower conveyor assembly roll 36 and to help prevent wrinkles and creases in the tail T as it is wound upon the log L. Although it is more preferred to fully wind the tail T upon the log L prior to moving the log L from the position shown in FIG. 7 between the lower and upper conveyor assemblies 4, 6, the system controller can operate to slow or even stop the rotation of lower conveyor assembly roller 36 and/or speed the rotation of the belt 28 to move the log L from the nip position while the tail T is still being wound. Therefore, the tail T preferably winds about the log L as the log L is moved to the next operation (discussed below). Such roll speed changes can automatically occur immediately after reversal of the conveyor assemblies 4, 6, but more preferably occur automatically via the controller after an amount of the tail T has been wound upon the log L. In the preferred embodiment, the system controller waits for the tail T to fully wind upon the log L, at or after which time the system controller changes the speeds of the lower conveyor assembly roller 36 and/or the belt 28 as discussed above to pass the log L out of the nip position of FIGS. 3–7.

As will be discussed more fully below, the location of the tail's end upon the log L is preferably monitored during and after the above processes to determine the rotational orientation of the log L in the tail sealer 2 for downstream log operations. The tail end location can be monitored by measuring rotation of the lower conveyor assembly roller 36 and/or the nip roller 24. After the tail T has been completely rolled upon the log L in the nip position shown in FIGS. 3–7, the end of the tail T can be monitored, for example, by continuing to monitor rotation of the conveyor assembly roller 36 and/or the nip roller 24 with the diameter of the log L being known. The location of the tail end is often important for downstream operations of the sealed log L. For example, it is often desirable to orient the logs L in a downstream accumulator (not shown) with the tail T of each log L in the same rotational position in the accumulator. As another example, when the tail T is ironed upon the log L in a downstream ironing roller assembly, proper ironing is often dependent upon the orientation of the log L in the ironing roller assembly after the log L has been rolled to a position therein. As such, the log L can be rotated to a desired angular orientation before being moved out of the nip position and onto the rolling surface 54.

Figure 8:
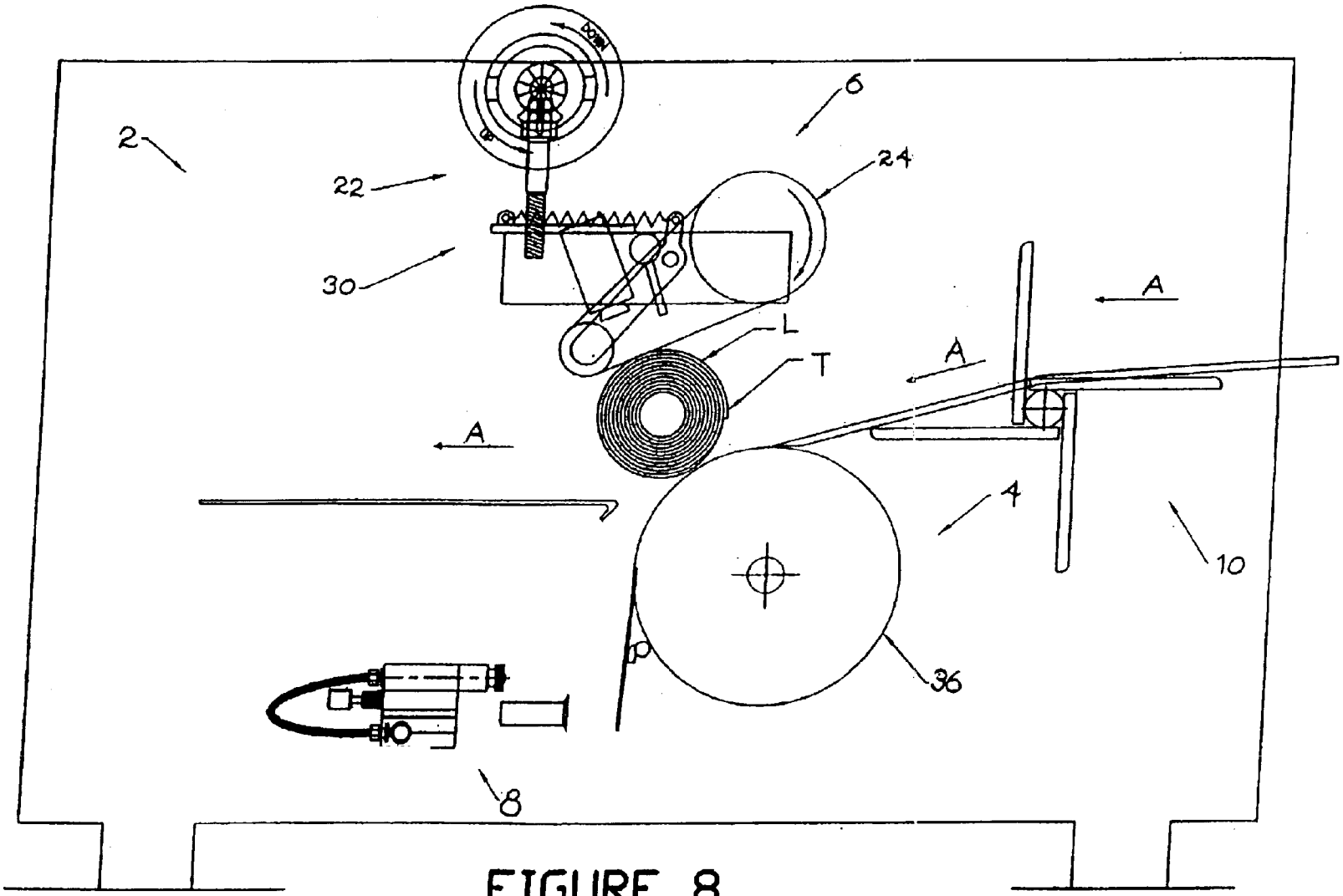
FIG. 8 is an elevational view of the tail sealer of FIGS. 1–7, showing the rewound log being moved from the nip position toward the roll surface by stopping the rotation of the lower conveyor assembly.
Figure 9:
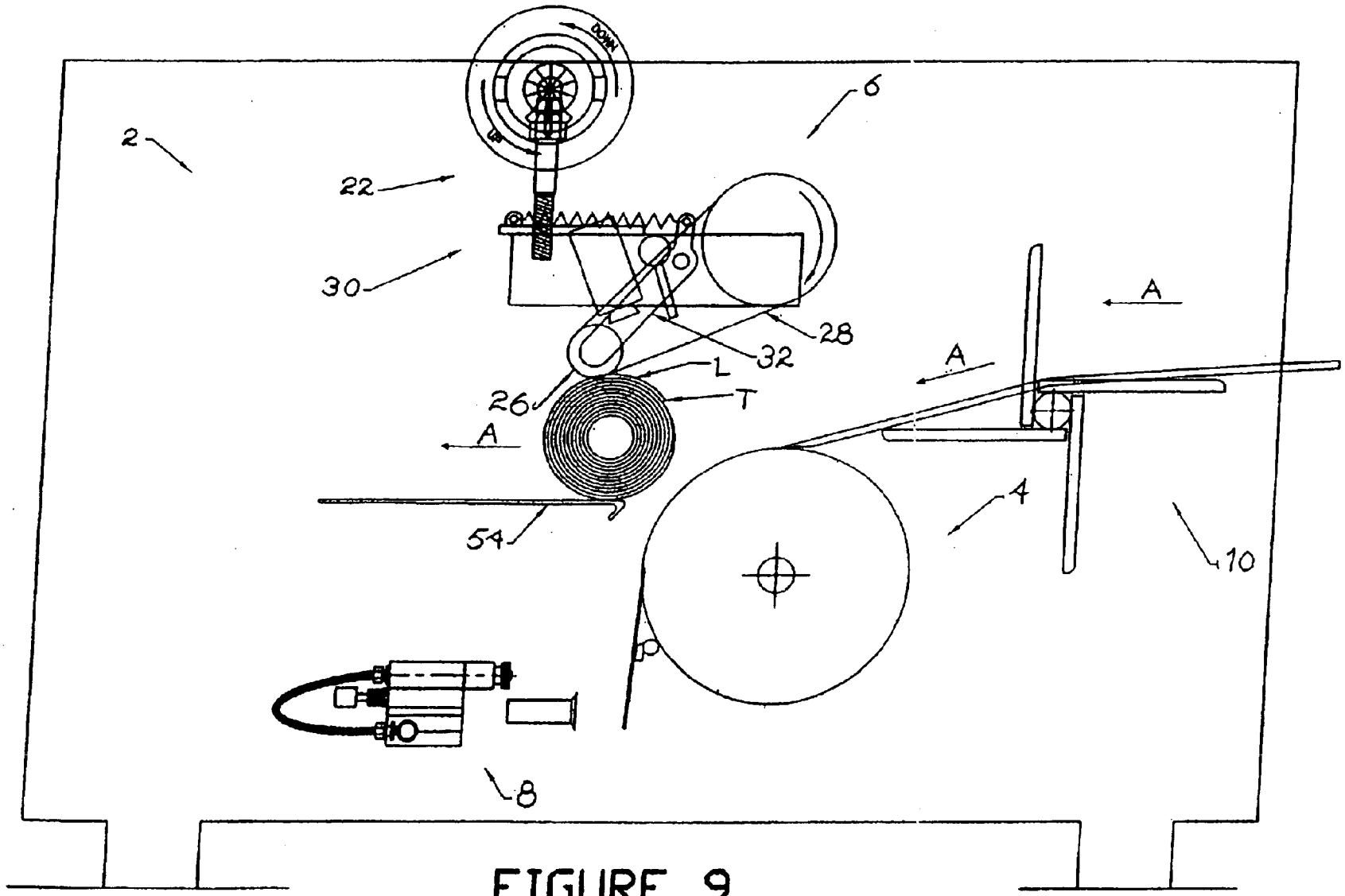
FIG. 9 is an elevational view of the tail sealer of FIGS. 1–8, showing the log leaving the lower conveyor assembly and moving across the roll surface.

With reference now to FIG. 8, the lower conveyor assembly roller 36 is now preferably slowed, stopped, or reversed with respect to the nip roller 24. Alternatively or in addition, the rotational speed of the nip roller 24 can be increased with respect to the lower conveyor assembly roller 36. As can be seen in FIG. 9, the log L is preferably rolled from between the upper conveyor assembly 6 and the lower conveyor assembly 4 to a position on top of a rolling surface 54. The rolling surface 54 preferably extends downstream from the rear of the lower conveyor assembly 4. Preferably, the log L remains between the rolling surface 54 and the belt 28 and/or tension roller 26 of the upper conveyor assembly 6 for rolling the log L along the rolling surface 54. If the tail T has not yet been completely wound upon the log L (as is the case when the log L has been moved from the nip position between the lower and upper conveyor assemblies 4, 6 during tail rewinding), tail rewinding continues as the belt 28 and tension roller 26 rolls the log L along the rolling surface 54. This winding causes the tail T with the adhesive thereon to eventually come into contact with the log L. The tension roller 26 preferably acts to press the tail T and adhesive against the log L to seal the log L. To this end, the spring-biased tension arm 32 preferably creates a pressure upon the passing log L while still permitting the tension roller 26 to ride up and over the log L. However, the tail T can instead be pressed against the log L by rolling upon the rolling surface 54 or by a downstream ironing roller assembly (not shown).

Figure 10:
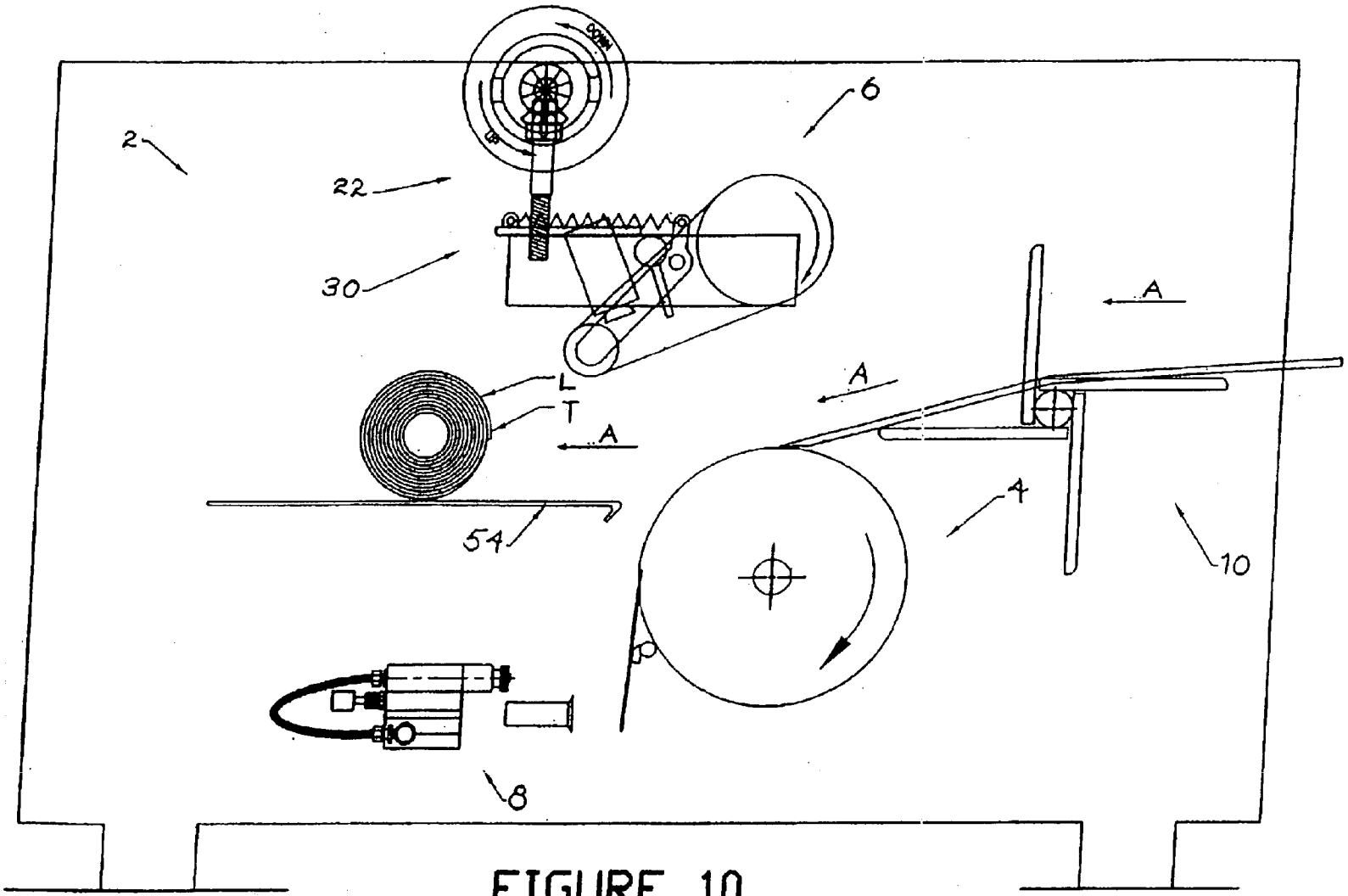
FIG. 10 is an elevational view of the tail sealer of FIGS. 1–9, showing the log rolling out of the tail sealer.

The log L eventually passes from beneath the upper conveyor assembly 6 and continues to roll down the rolling surface 54 to downstream equipment (see FIG. 10). If desired, the rolling surface 54 can be declined away from the lower and upper conveyor assemblies 4, 6 to encourage the logs L to roll away. The rolling surface 54 can also or instead be provided with one or more conventional conveyor belts carrying the logs L away, or a belt can be located above the rolling surface 54 for rolling the logs L across the rolling surface 54.

The Second Preferred Embodiment

Figure 11:
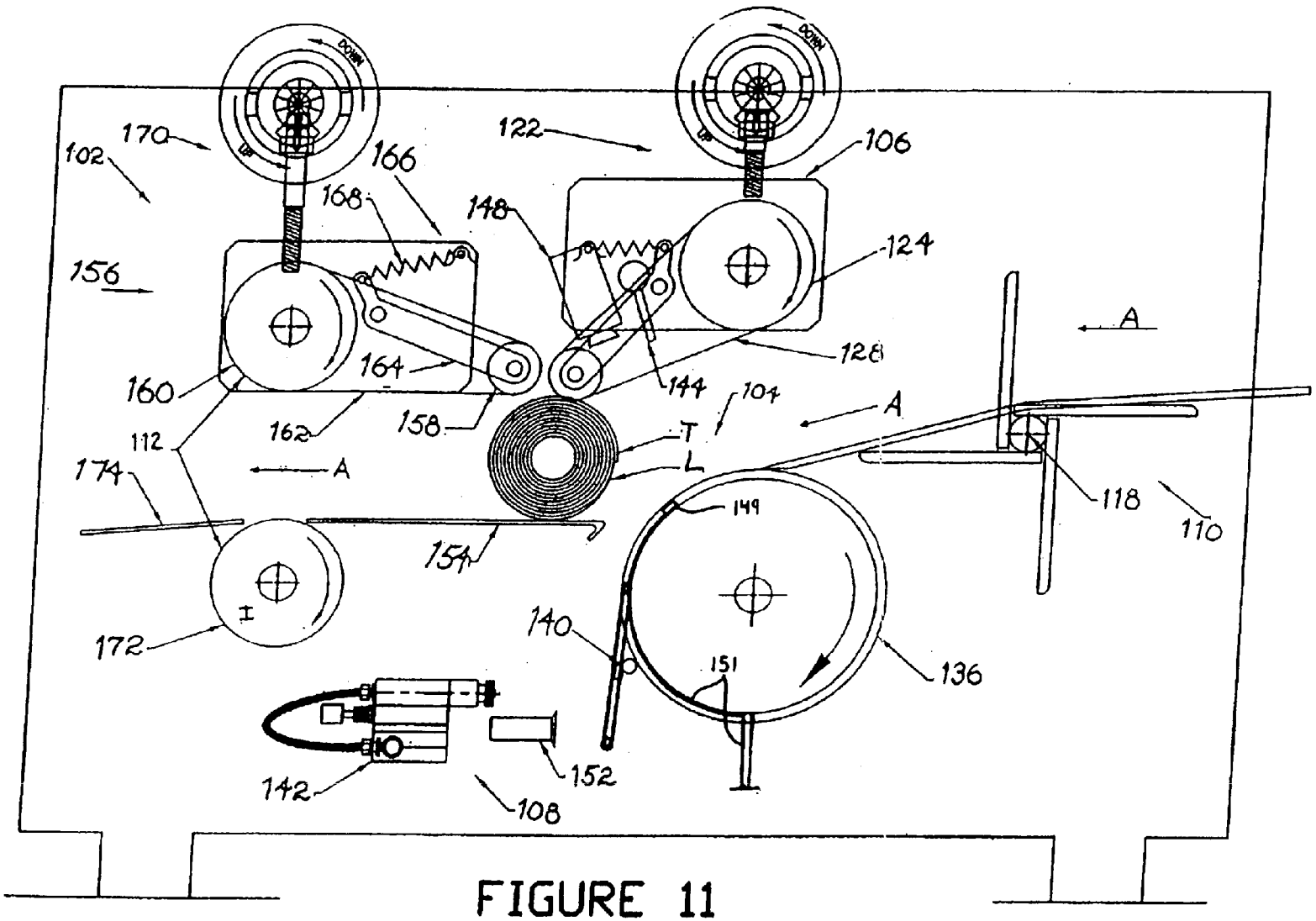
FIG. 11 is an elevational view of the tail sealer apparatus according to a second preferred embodiment of the present invention, showing a log at a tail sealing stage similar to that shown in FIG. 9 of the first preferred embodiment.
Figure 12:
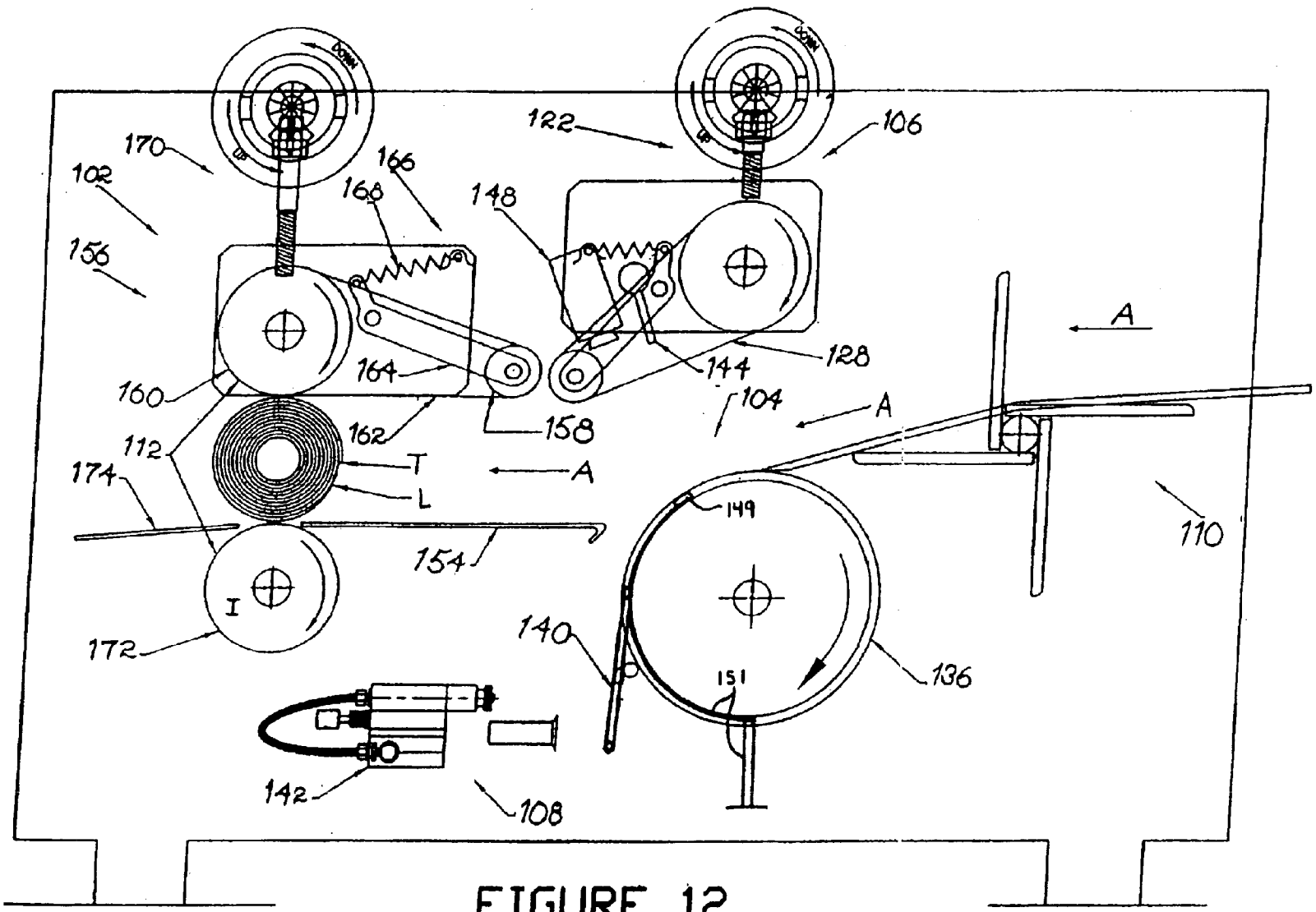
FIG. 12 is an elevational view of the tail sealer of FIG. 11, showing the log in an ironing roll position.
Figure 13:
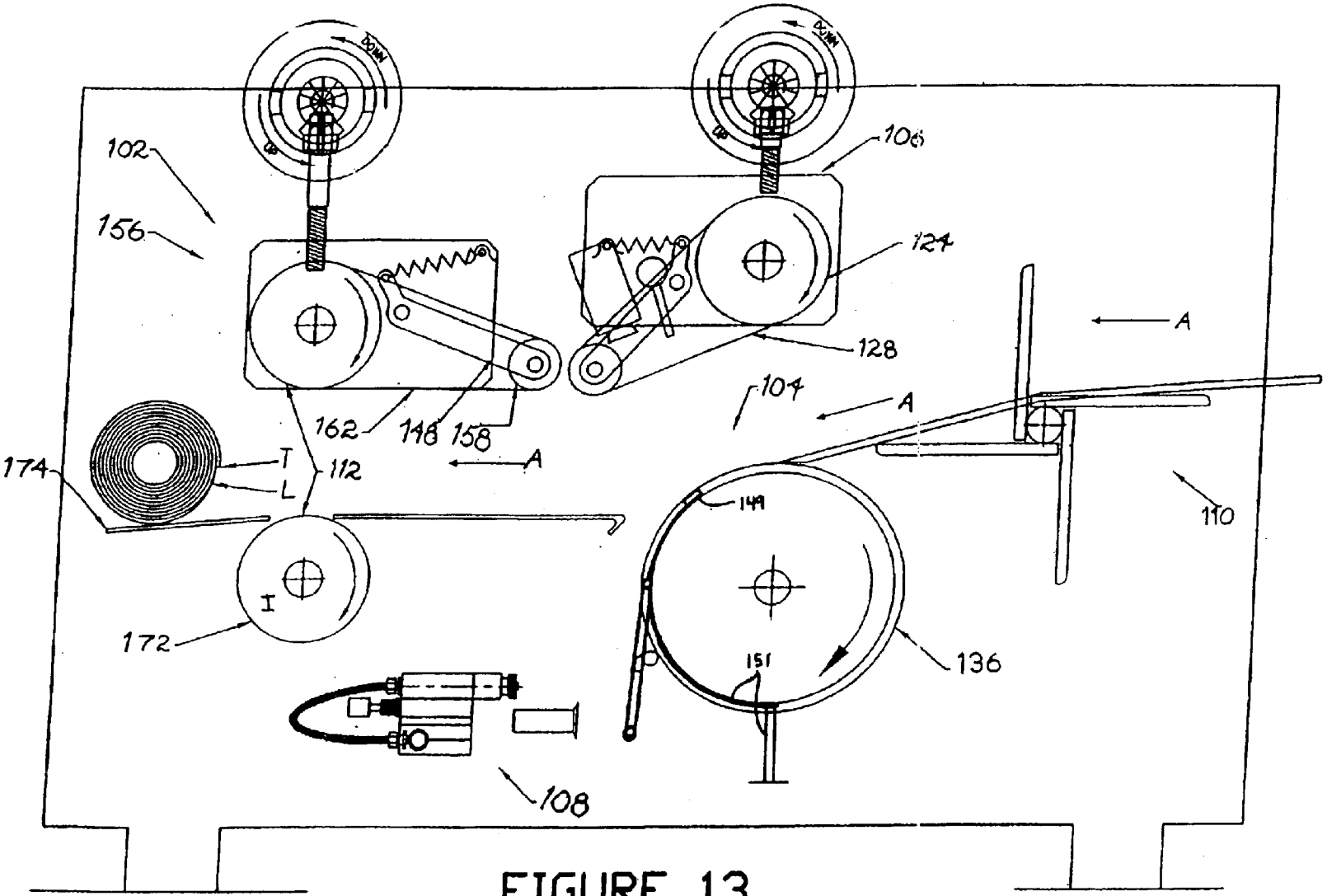
FIG. 13 is an elevational view of the tail sealer of FIGS. 11 and 12, showing the log rolling out of the tail sealer.

A second preferred embodiment of the present invention is illustrated in FIGS. 11–13. With exceptions noted below, the tail sealer system shown in FIGS. 11–13 is substantially the same as that shown in FIGS. 1–10 and described above with respect to the first embodiment, and has additional structure downstream of the upper conveyor assembly 106 for further controlling the logs L and the tail ironing process.

The embodiment of the present invention illustrated in FIGS. 11–13 employs belt conveyors for the tail support 40. Such belt conveyors (only one of which is visible in FIGS. 11–13) can be employed with any embodiment of the tail sealer according to the present invention, and preferably extend from the roller 136 to a location a distance away from the roller 136 for providing support to the tail T during adhesive application as described in greater detail above.

The embodiment of the present invention illustrated in FIGS. 11–13 also employs a sensor 149 located within a circumferential groove, recess, or other aperture in the roller 136. This sensor 149 preferably operates in a manner similar to the sensor 148 located in the upper conveyor assembly 106 described above, and can be used in place of the sensor 148 in the upper conveyor assembly 106. The sensor 149 is preferably held within the circumferential groove of the roller 136 by an arm 151 that extends partially around the roller 136 to a location where it can be connected to the ground, the frame of the tail sealer 102, or to another structural member.

As described in greater detail above with regard to the illustrated preferred embodiment of FIGS. 1–10, any number of sensors can be employed to detect the position of the tail T during the unwinding and adhesive application processes of the tail sealer 102. In this regard, any of the tail sealer embodiment described herein can employ one sensor 148, 149, 152 to detect the end of a log tail T (in which case the position of the tail T can be known at any or all times by the measured or detected amount of rotation of the roller 136 and/or upper conveyor assembly 106), can employ two or all three of the sensors 148, 149, 152 illustrated in FIGS. 11–13 (used with or without measured or detected rotation as just mentioned), can employ even more sensors as desired or necessary, and the like.

The tail sealer system 102 of the second preferred embodiment has a ironing conveyor assembly 156 preferably located immediately downstream from the upper conveyor assembly 106 and above the rolling surface 154. Preferably, the ironing conveyor assembly 156 is of similar structure and operation as the upper conveyor assembly 106, but is reversed in orientation as can be seen in FIGS. 11–13. The sensor 148 can be located as shown, can be located on the ironing conveyor assembly 156, or can be located in any other position in which the sensor 148 is capable of detecting tail position as described in greater detail above. Similarly, it should be noted that the jets 144 need not necessarily be attached or otherwise mounted to the upper conveyor assembly 106, and can instead be located on the ironing conveyor assembly 156 and be directed toward the log L and tail T when the log L is in the nip position between the nip roller 124 and the lower conveyor assembly roller 136. Both the sensor 148 and the jets 144 can even be mounted exterior to the upper conveyor assembly 106 and the ironing conveyor assembly 156 (e.g., upon a frame of the tail sealer system 102, a wall thereof, etc.).

Like the upper conveyor assembly 106, the ironing conveyor assembly 156 preferably has a tension roller 158 and a nip roller 160 about which runs an ironing belt 162. The tension roller 158 is preferably mounted for rotation to a tension arm 164 which is itself pivotably mounted under spring force from a tensioning mechanism 166 (e.g., having a spring 168 or other device capable of exerting bias force upon the tension arm 164) in preferably the same or similar manner to the upper conveyor assembly 106. Like the upper conveyor assembly 106, the ironing conveyor assembly 156 can be driven by any conventional motor, engine, or other driving device. Preferably however, the nip roller 160 is driven by a servo-controlled motor which is controlled by the conventional system controller (not shown).

The ironing conveyor assembly 156 runs along the rolling surface 154 to controllably transport the logs L from the upper conveyor assembly 106 as shown in FIG. 11 to an ironing position shown in FIG. 12. Therefore, the ironing conveyor assembly 156 is preferably located above the rolling surface 154 with the ironing belt 162 located a distance sufficient to permit logs L to pass between the ironing belt 162 and the rolling surface 154. This distance is preferably adjustable not only by the movable tension roller 158 under spring force from the tensioning mechanism 166, but also by a conventional adjustment assembly 170. The adjustment assembly 170 for the ironing conveyor assembly 156 is preferably the same as the adjustment assembly 122 for the upper conveyor assembly 106 described above with reference to the first preferred embodiment of the present invention. Both devices preferably permit vertical (and if desired, horizontal) adjustment of their respective conveyor assemblies 156, 106 in a conventional fashion.

The second preferred embodiment of the present invention also preferably has an ironing roll 172 at an ironing position located downstream from the lower and upper conveyor assemblies 104, 106 (see the location of the log L in FIG. 12). The ironing roll 172 is conventional in nature and is preferably mounted for rotation at the end of the rolling surface 154. With continued reference to FIGS. 11 and 12, logs L exiting from between the lower and upper conveyor assemblies 104, 106 are preferably rolled by the ironing belt 162 of the ironing conveyor assembly 156 across the roll surface 154. This motion causes the tail T to come into contact and bond to the surface of the log L via the sprayed adhesive if the tail T has not yet been wound upon the log L by rolling between the lower and upper conveyor assemblies 104, 106. To further secure the tail T to the surface of the log L via the adhesive, the ironing roll 172 presses the tail T against the log L to ensure that the adhesive secures the tail T against the log L. Though not part of the preferred embodiment described herein, the ironing roll 172 can be heated in a conventional manner by a heater assembly (not shown). The heat supplied to the tail T and log L via the heated ironing roll 172 can be used to further assure proper adhesion between the tail T and the log L. Heater systems for hot rollers are well-known in the art and are therefore not discussed in greater detail herein. The use of a hot ironing roll 172 will largely depend upon the type of adhesive used and the need for heat to assist the adhesive in bonding the tail T to the log L.

Preferably, the ironing roll 172 is turned in a conventional manner in a clockwise direction (see the arrow I in FIGS. 11–13) by a motor or other conventional driving device (not shown) at a constant surface speed which is slightly slower than the speed of the ironing belt 162. Therefore, when the ironing belt 162 rolls the log L into contact and over the ironing roll 172, the log L rotates as its translational speed slows significantly. This movement permits the log L to complete one or more rotations over the ironing roll 172 before exiting the ironing conveyor assembly 156. The surface speed of the ironing roll 172 can instead be kept at substantially the same speed of the ironing belt 162 for a period of time sufficient to roll the log L between the ironing belt 162 and the ironing roll 172 for one or more complete rotations, after which time the ironing roll 172 can be slowed or the belt speed can be increased to eject the log L from the ironing position. Alternately, the ironing roll 172 can remain normally stationary and be temporarily turned by its motor only when the log L is rolled thereover. In this alternate configuration, one or more sensors (not shown) can be mounted near the ironing roll 172 to detect the approach of the log L and to send a signal to a controller to turn the ironing roll 172 on for a set period of time or a set number of rotations. Similarly, the sensor(s) can also send a signal to the ironing conveyor assembly 156 which remains normally stationary until the signal is received to thereby begin turning the tension and nip rollers 158, 160 and the ironing belt 162 for the approaching log L. When the ironing roller 172 is intermittently operated in such manner, the ironing roll 172 preferably rotates at a surface speed equal to the speed of the ironing belt 162, thereby keeping the log L in a fixed translational position between the ironing roll 172 and the ironing belt 162 while the log L is being rotated on top of the ironing roll 172.

Other conventional manners exist for turning the ironing roll 172 on only when the log L is rolled thereupon, such as by measuring the amount of belt movement (measuring the rotation of the tension and nip rollers 158, 160, respectively) or by turning on the motor driving the ironing roll 172 at timed intervals corresponding to the frequency of and coinciding with logs L passing across the ironing roll 172. The manners described above for turning the ironing roll 172 only when logs are present or at other particular times are well-known in the art, and therefore are not described in greater detail herein.

After the ironing belt 162 has rolled the log L over the ironing roll 172, the ironing belt 162 preferably rolls the log L to an exit ramp 174, where the sealed log L preferably rolls by gravity out of the tail sealer system 102 as shown in FIG. 13.

As mentioned with respect to the first preferred embodiment above, the exact position of the sealed tail T on each log L is often important to downstream operations. Therefore, tail orientation upon each log L is preferably controlled in the present invention. To accomplish this task, the location of the end of each tail T can be monitored as the logs L pass through the tail sealer system 102. Preferably, this location is measured by the number of rotations of the log L as it passes from the nip position between the lower conveyor assembly roller 136 and the upper conveyor assembly nip roller 124 (where the end of the tail T has been detected by the sensor 148, 149 or has been otherwise detected or measured as described in greater detail above) through the ironing roll position shown in FIG. 12. The number of rotations of the log L through the lower, upper, and ironing conveyor assemblies 104, 106, 156 can be measured by knowing the size of the log L and by measuring the amount of movement or rotation of the lower conveyor assembly roller 136, the upper conveyor assembly belt 128, and the ironing conveyor assembly belt 162.

Once the log L reaches the ironing roll 172, the speed of the ironing roll 172 and/or the speed of the ironing belt 162 can be adjusted by the system controller to ensure that the tail T of the log L is positioned at a precise location on the log's circumference when the log L leaves the ironing roll 172. Alternately, the length of the path each log L travels from the lower conveyor assembly roll 136 to the ironing roll 172 can be selected to position the tail T of each log L in a particular orientation when it reaches the ironing roll 172. The speed of the ironing roll 172 and the ironing belt 162 can then be set to rotate the log L through a set number of rotations to eject the log L positioned in a particular orientation. As yet another alternative, the position of the tail T of each log L can even be directly measured in a conventional manner by one or more sensors (not shown) mounted upstream or near the ironing roll 172. The tail end position read by the sensor(s) can then be sent to the system controller which adjusts the speed of the ironing roll 172 and/or the ironing belt 162 to adjust the position of the tail T when the log L is ejected from the ironing position. It will be appreciated that the position of the tail T of a log L can be adjusted in a number of different manners well-known to those skilled in the art and which fall within the spirit and scope of the present invention.

The Third Preferred Embodiment

Figure 14:
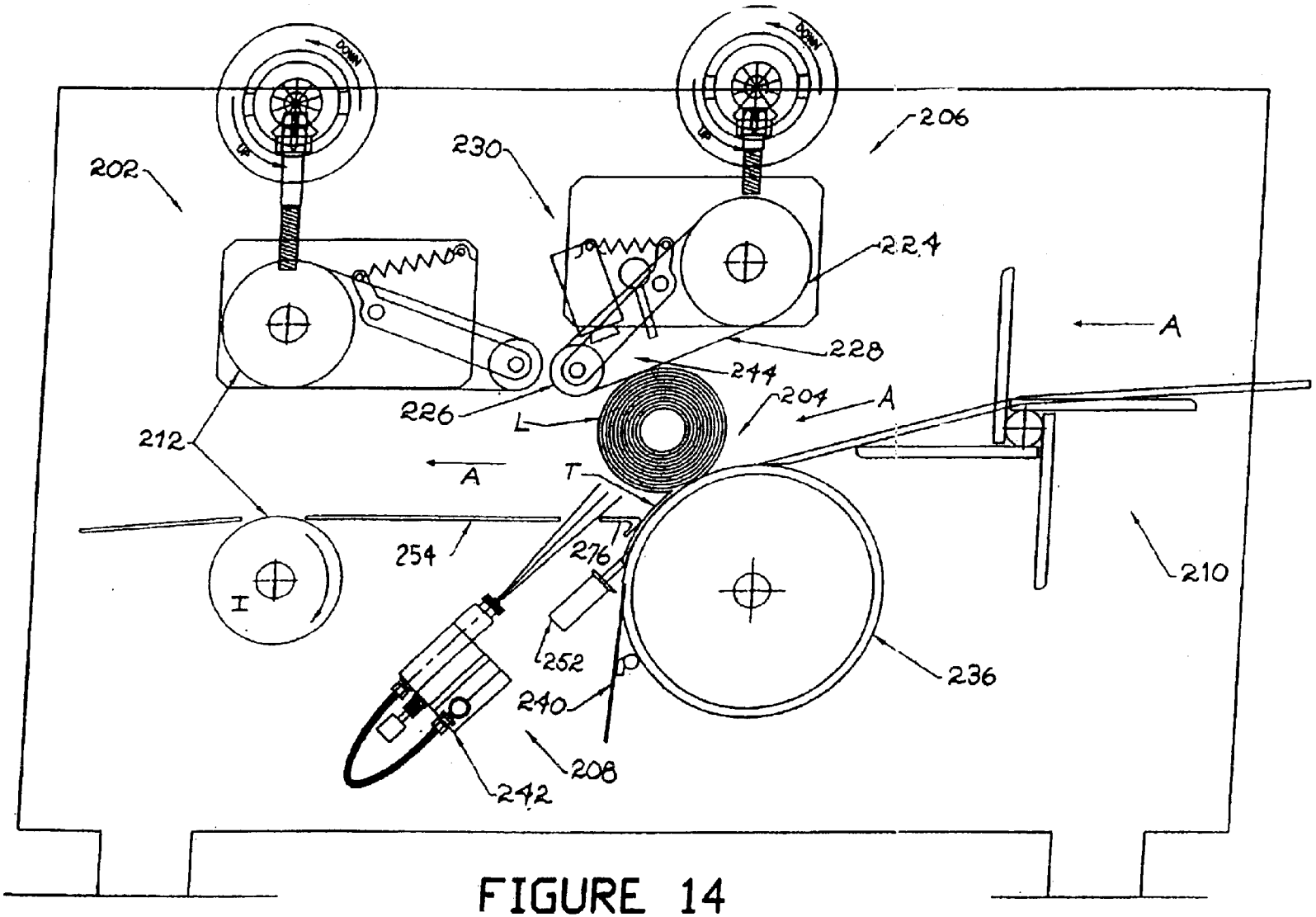
FIG. 14 is an elevational view of the tail sealer apparatus according to a third preferred embodiment of the present invention, showing a log having adhesive sprayed upon the log prior to the tail being rewound.
Figure 15:
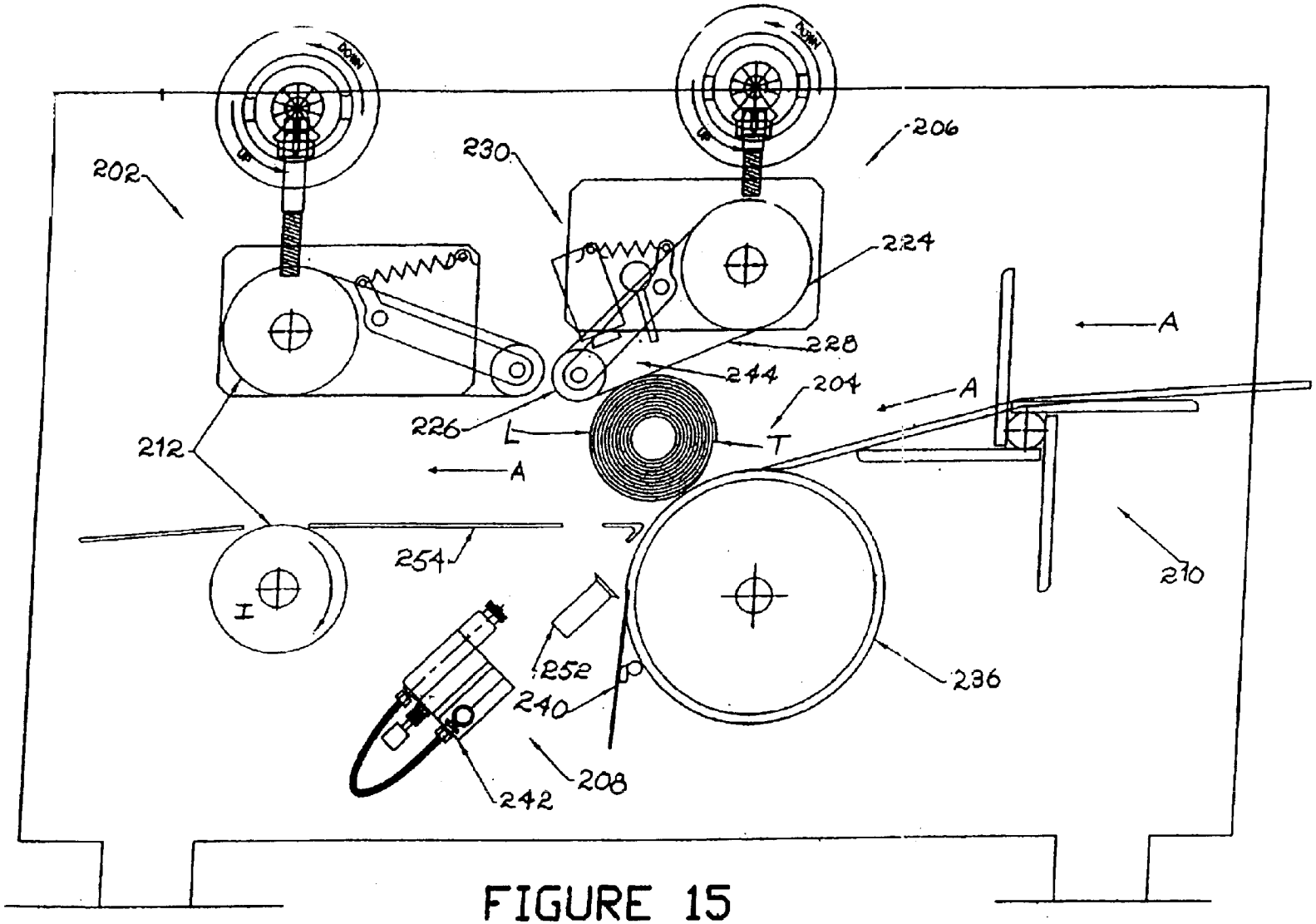
FIG. 15 is an elevational view of the tail sealer of FIG. 14, showing the tail being rewound on the log by reversed rotation of the upper and lower conveyor assemblies.

A third preferred embodiment of the present invention is illustrated in FIGS. 14 and 15. With the exception of the following description, the present invention according to the third preferred embodiment is substantially the same and operates in substantially the same manner as that disclosed above with reference to the first preferred embodiment of the present invention.

In the tail sealer system 202 of the third preferred embodiment, the adhesive assembly has one or more sprayers 242 directed toward the log L rather than toward the tail T of the log L. Therefore, as the log L moves through the tail sealer system 202, adhesive is applied to the log L and the log L is subsequently rolled to roll the tail T on top of the sprayed area to seal the log L. In order to accomplish this task, the tail sealer system 202 preferably performs the same functions as described above and illustrated in FIGS. 1–4 with reference to the first preferred embodiment of the present invention. While or immediately after the tail T is unwound from the log L, the log L is preferably moved from the nip position (between the lower conveyor assembly roller 236 and the nip roller 224) to the position shown in FIG. 14. Once in this adhesive position, an applicator sensor 252 positioned to detect the presence of the log L preferably sends a signal to the system controller which sends a signal to the adhesive assembly 208 to fire the sprayers 242. After the sprayers 242 have been fired, the belt 228 continues to turn via the nip and tension rollers 224, 226 while the lower conveyor assembly roller 236 is turned in a clockwise direction as viewed in the figures to preferably rotate the log L in place until the tail T is wound upon the log L as shown in FIG. 15. Preferably after the tail T is wound upon the log L (but in other embodiments, while the tail T is being rewound), the system controller causes the lower conveyor assembly roller 236 to stop and/or reverse rotation, thereby causing the log L to be ejected to the rolling surface 254.

It should be noted that the process just described can be performed by the tail sealer system 202 in discreet steps with the log L pausing at the adhesive application position, or can be performed in a continuous motion in which the log L progresses through the system substantially without pausing. Alternatively, the process just described can be altered so that the log L remains in the same position between the nip roller 24 and the lower conveyor assembly roller 26 while the tail T is unwound and rewound upon the log L (as in the first preferred embodiment of the present invention described above). In such a case, the adhesive sprayers 242 would preferably be re-positioned from their locations shown in FIGS. 14 and 15 to spray adhesive upon the log L further upstream of the location shown in FIGS. 14 and 15. Subsequent operations by the tail sealer system 202 are generally the same as that described above with reference to the first preferred embodiment of the present invention.

The length of the tail T unwound from the log L (and therefore, the portion of the log L exposed to the sprayers 242) is directly dependent upon the difference in speed between the belt 228 and the lower conveyor assembly roller 236 and the amount of tail length unwound while the log L is in the nip position between the lower conveyor assembly roller 236 and the nip roller 224. Fast movement of the belt 228 relative to the lower conveyor assembly roller 236 will result in a shorter tail T, while slower relative movement will result in a longer tail T. The speeds of the belt 228 and the lower conveyor assembly roller 236 can be controlled in a manner as described above with reference to the first preferred embodiment of the present invention.

In order to provide additional support to the log L in the adhesive application position shown in FIG. 14 (depending upon the spacing between the lower conveyor assembly roller 236 and the rolling surface 254), the tail sealer system 202 can be provided with a log support 276 mounted in a conventional manner between the lower conveyor assembly roller 236 and the rolling surface 254. The log support 276 is preferably sufficiently long or has portions which are spaced sufficiently to support the log L temporarily while adhesive is sprayed upon the log L. It should be noted that rather than employ an applicator sensor 252 as described above, the presence of the log L in the adhesive application position can be triggered by a number of other devices well-known to those skilled in the art. For example, the log support 276 can have a pressure sensing device (not shown) connected thereto in a conventional manner and capable of detecting pressure or weight of the log L upon the log support 276. The pressure sensing device can be a pressure switch, pressure plate, a weight scale or other conventional device capable of detecting differences in pressure or weight. When the presence of the log L is thereby detected, the pressure sensing device triggers the sprayers 242 in the same manner as the applicator sensor 252 described above. As another example, a trip switch or other like device can be located upon the log support 276, on the edge of the rolling surface 254, etc. to trip when the log L moves to the adhesive application position.

It should be noted that the applicator sensor 252 need not be directed upwardly as illustrated in FIGS. 14 and 15. Instead, the applicator sensor 252 can be position in a manner similar to that shown in FIGS. 1–13 to detect the presence of the tail end upon or beside the lower conveyor assembly roll 236. For example, the log L can be rolled to unwind the tail T from the log L before the log L reaches the adhesive application position shown in FIGS. 14 and 15. When the end of the tail T reaches the line of sight of the applicator sensor 252 directed toward the lower conveyor assembly roll 236, the applicator sensor 252 can send a signal to adjust the speed of the roller 236 and/or the nip roller 224 to move the log L into the adhesive application position. Tail length adjustment can therefore be performed in much the same manner as that described above and also with reference to the first and second preferred embodiments of the present invention.

In each embodiment of the tail sealer system just described, rolls of wound product L are quickly passed through a series of stations which index the logs L, free the tails for later manipulation, consistently create desired tail lengths and adhesive locations without tail wrinkling, and securely bond the tails T to the logs L. Each embodiment performs these functions with a streamlined system having much fewer parts, components, and assemblies than conventional tail sealer systems and methods, thereby significantly lowering system cost and maintenance.

The embodiments disclosed above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, although only one log L is shown in the figures as being present in the tail sealer system 2, 102, 202, at one time, multiple logs L can certainly be accommodated within the tail sealer systems 2, 102, 202, each log L being located at different stages in the tail sealing process (represented, for example, by each of FIGS. 2–10 in the first preferred embodiment). In one example of such operation, a first log L can be introduced into the tail sealer system 2, 102, 202 as shown in FIG. 2. Upon reaching the tail sealing stage shown in FIG. 4, another log L can be introduced into the system by being rolled into the rotary indexer 14. Therefore, as the first log L proceeds through the remaining tail sealing steps represented by FIGS. 5–10, the second log L follows three steps behind the first log L. Further logs can similarly be introduced in series at three step intervals. With multiple logs passing through the tail sealer system 2, 102, 202 simultaneously, the product output of the tail sealer system 2, 102, 202 increases significantly without the addition of more elements or assemblies.

As another example of the various changes possible to the tail sealer systems 2, 102, 202 described above which fall within the scope of the present invention, it will be noted that alternatives to the particular rotary indexer assembly 4, 104, 204 disclosed in the embodiments are possible. One having ordinary skill in the art will appreciate that a number of other devices well-known in the art for feeding rolled products in a controlled manner would work equally well to index logs L into the tail sealer systems 2, 102, 202. Tail sealer systems 2, 102, 202 employing such other indexing devices fall within the spirit and scope of the present invention.

Although a roll such as that described above and illustrated in the figures is preferred for the lower conveyor assembly 4, 104, 204, it is possible to replace the lower conveyor assembly roller 36, 136, 236 with a number of alternative devices and assemblies capable of performing the same functions as the lower conveyor assembly roller 36, 136, 236. In each preferred embodiment and in each alternative embodiment of the lower conveyor assembly 4, 104, 204, a surface is provided which is preferably movable to roll the log L in place in the system, to move the log L while the log L is rolled, or to perform both functions as in the preferred embodiments above. Also in each preferred embodiment and in each alternative embodiment of the lower conveyor assembly 4, 104, 204, the movable surface acts to wind, unwind, or to both wind and unwind the tail T of the log L. In alternative embodiments of the present invention, the lower conveyor assembly roller 36, 136, 236 can be replaced by one or more belts running around pulleys or sprockets driven in by a motor or other conventional driving device. As used above and in the appended claims, the term "roller" (i.e., a device capable of rolling logs L) therefore not only includes an elongated member having a round cross-section such as that shown in the figures, but also includes a belt or like assembly as just described. In such case, the tail support 40 can extend from the surface of the endless belt(s) in much the same manner as it does in from the surface of the lower conveyor assembly roller 36, 136, 236 of the preferred embodiments. It is even possible to eliminate the tail support 40, 140, 240 altogether by replacing the tail support 40, 140, 240 with a stretch of the endless belt(s) which support the tail T of each log L during the adhesive spraying process. In some embodiments, the tail support 40, 140, 240 can also be removed. In such cases, it is preferable to locate the adhesive assembly 8, 108, 208 and/or the applicator sensor 52, 152, 252 so that the spray location upon the tail T is at a point on the lower conveyor assembly roller 36, 136, 236 where the tail T is supported to some degree by the lower conveyor assembly roller 36, 136, 236.

Another alternative to the lower conveyor assembly roller 36, 136, 236 disclosed in the preferred embodiments is a vacuum roll or vacuum belts. Specifically, the lower conveyor assembly roller 36, 136, 236 can be a conventional vacuum roll within which a vacuum is created by connecting the vacuum roll to a vacuum source. Vacuum connections (such as rotary vacuum valves and rotary unions) for connecting vacuum rolls to a source of vacuum are well known to those skilled in the art and are therefore not described further herein. Examples of such vacuum systems and vacuum rolls are disclosed in, for example, U.S. Pat. No. 4,494,741 issued to Fischer et al. and U.S. Pat. No. 4,917,665 issued to Couturier, the teachings of which are incorporated herein by reference insofar as they relate to vacuum rolls and vacuum connections to such rolls. As with most conventional vacuum rolls, the surface of the vacuum roll can have a number of apertures therethrough to create a suction on the surface for holding the tail against the surface. Vacuum can be continuously ported to the lower conveyor assembly roller for continuous suction on the lower conveyor assembly roller. Alternatively, vacuum can be controllably ported to the lower conveyor assembly roller by a system controller operable in a conventional manner.

For increased vacuum roll efficiency, vacuum is preferably ported via the rotary vacuum valves and rotary unions to the vacuum roll only in that portion of the vacuum roll where suction is needed to manipulate the log tails T (e.g., in the upper left-hand quadrant of the roll 36, 136, 236 illustrated in the figures). Such vacuum rolls are also well-known to those skilled in the art.

As mentioned above, the lower conveyor assembly roller 36, 136, 236 can be replaced by one or more vacuum belts, each of which has a vacuum box or enclosure over or past which the vacuum belts pass. Like the vacuum roll described above, the vacuum belts preferably have a number of apertures therethrough to create a suction on the surface of the vacuum belt for holding the log tails thereto. Also as with the vacuum roll, the vacuum box or apertures are preferably only located in those areas of the belt paths in which vacuum is needed for control of the log tails. Systems for controlling the application of vacuum to vacuum belts and vacuum rolls (and thereby to control the log tails thereon) are well-known to those skilled in the art and are therefore not disclosed further herein.

Yet another alternative to the lower conveyor assembly roller 36, 136, 236 employed in the preferred embodiments of the present invention is a roller, belt, or belts such as those just described, but which employ electrostatic force rather than vacuum and suction force to controllably retain log tails T to the roller, belts, or belts. Specifically, a conventional electrostatic generator can be mounted in a conventional manner beneath or beside the roller 36, 136, 236, belt or belts to generate an electrostatic field upon the outer surface of the roller 36, 136, 236, belt or belts at times controlled by the system controller when it is desired to hold the tail T of a log thereagainst (e.g., in the process steps represented by FIGS. 2–9 of the first preferred embodiment). Such electrostatic generators, their manner of connection, and their operation are well-known to those skilled in the art and are therefore not described further herein.

Systems employing either a vacuum or an electrostatic roller 36, 136, 236, belt or belts as described above offer increased tail control and better design flexibility for the adhesive assembly 8, 108, 208 and the tail support 40, 140, 240. Because the log tails T can now be positioned as desired upon the roller 36, 136, 236, belt or belts (even unwound to a position beneath the lower conveyor assembly while being held thereto), the adhesive assembly 8, 108, 208 can be located almost anywhere in front of, behind, or beneath the roller 36, 136, 236, belt, or belts, and can have the sprayers 42, 142, 242 directed as desired. Because the log tails T can be held against the lower conveyor assembly 4, 104, 204, tail rewinding operations such as those illustrated in FIGS. 7–9 of the first preferred embodiment can be performed with less chance of wrinkling and folding. As the log L is rewound and exits the nip position illustrated in FIGS. 4–7, the tail T can be gradually "peeled" off of the roller 36, 136, 236, belt, or belts to keep the tail T taut and wrinkle-free during rewinding. Also, adhesive can be applied to the tail T while it is held against the lower conveyor assembly roller 36, 136, 236, belt, or belts rather than employing a tail support 40, 140, 240. Alternatively, vacuum or electrostatic force can be generated in well-known manners upon only desired portions of the roller 36, 136, 236, belt or belts (e.g., to the upper left-hand quadrant of the roller 36, 136, 236 shown in the figures) to release log tails T to a tail support 40, 140, 240 for the adhesive application step.

In some alternative embodiments of the present invention, the lower conveyor assembly roller 36, 136, 236 and the alternative lower conveyor assembly surfaces discussed above do not move. Specifically, the lower conveyor assembly 4, 104, 204 can be one or more stationary surfaces which only act to convey the logs L by channeling the logs L from the nip position through to the rolling surface 54, 154, 254. In such cases, the logs L preferably roll by movement of the upper conveyor assembly nip roller 24, 124, 224, belt 28, 128, 228, tension roller 26, 126, 226, or combination thereof. While this arrangement affords limited ability of the logs L to roll in place between the lower and upper conveyor assemblies 4, 104, 204, 6, 106, 206, logs L which are rolled into the nip position with a precise tail orientation (i.e., detected via conventional tail location devices, sensors, and the like upstream of the nip roller 24, 124, 224 or upstream of the rotary indexer assembly 10, 110, 210) can have their tails T blown down upon the surface by the jets 44, 144, 244. Because the location of the tails T are thereby known prior to entering the nip position, the location of the tails T upon the surface and the tail support 40, 140, 240 are also known. Therefore, the adhesive assembly 8, 108, 208 can be positioned beside the tail support 40, 140, 240 to direct adhesive spray at a desired location upon the tail T when in its location. After or during adhesive application, the upper conveyor assembly 4, 104, 204 can be operated to roll each log L toward the rolling surface 54, 154, 254, thereby causing the tail T to be wound upon the log L. In this alternative embodiment of the present invention, the tail T is not unwound in the manner of the preferred embodiments, but is instead blown off the log L directly upon the surface of the lower conveyor assembly roller 36, 136, 236 and the tail support 40, 140, 240 in the position in which adhesive is to be applied. Although the ability to adjust tail lengths is more restricted, such a system design is simpler and easier to control and operate.

Each of the preferred embodiments disclosed above and illustrated in the figures employs an upper conveyor assembly 6, 106, 206 having a nip roller 24, 124, 224, a tensioning mechanism 30, 130, 230 (with a tension roller 26, 126, 226), and a belt 28, 128, 228. However, it should be noted that a the preferred conveyor assembly 6, 106, 206 can be replaced by a number of different elements and mechanisms capable of performing the same or similar functions as the disclosed upper conveyor assembly 6, 106, 206. For example, the upper conveyor assembly 6, 106, 206 need not have a tension roller 26, 126, 226 or even a tensioning mechanism 30, 130, 230. The upper conveyor assembly 6, 106, 206 can be just an upper nip roller whose vertical and/or horizontal position is adjustable as described in the preferred embodiments above via an adjustment assembly. In such case, logs L following the operational steps described above are preferably wound fully before being ejected from the nip position.

As another example, the upper conveyor assembly 6, 106, 206 can be replaced by a surface (e.g., a plate or series of plates, one or more rods running above and along the lower conveyor assembly, and the like), in which case logs L are rolled through the nip position by the lower conveyor assembly with the upper conveyor assembly helping to control and funnel movement of the logs L through the apparatus. The surface is preferably movable toward and away from the lower conveyor assembly 4, 104, 106 in much the same manner as the upper conveyor assemblies 6, 106, 206 of the preferred embodiments described above, and can include portions which are shaped to accommodate logs L in various positions from the nip position to the rolling surface 54, 154, 254. For example, the surface could be a plate pivotable about a pivot point above the rolling surface 54, 154, 254 and having an inverted U-shaped portion at approximately the same position as the nip roller 24, 124, 224 in the preferred embodiments above. The plate would be pivotable to swing the U-shaped portion toward and away from a log L in the nip position to retain the log L there while the tail T of the log T is blown off the log L, unwound, sprayed with adhesive, and then rewound. Other plates, surfaces, and plate or surface shapes are also possible to maintain the log L in a particular location upon the lower conveyor assembly 4, 104, 204 while winding, adhesive applicating, and rewinding operations are performed, all of which fall within the spirit and scope of the present invention.

Therefore, the upper conveyor assembly of the present invention need not have rollers or belts. The upper conveyor assembly need not be anything more than a surface movable with respect to the lower conveyor assembly to funnel logs L through the apparatus and preferably also to retain the logs L in one or more positions by virtue of the upper surface's shape and position with respect to the lower conveyor assembly.

It should be noted that several adhesives used to secure the tail T to the log L can be employed with satisfactory results. Although some of such adhesives bond more securely if subjected to heat (for example, from an ironing roll 172 supplying heat), many adhesives bond adequately without the need for heating. Therefore, when such adhesives are used, the ironing roll 172 shown in the second preferred embodiment of the present invention need not be heated, thereby saving system cost and system maintenance cost. Whether or not hot ironing rolls 172 are used, any number of ironing rolls 172 can be employed (rather than just one as shown in the figures). Also, where heat is desired to be applied to the tails T and logs L, the application of heat to the logs L need not necessarily be through hot rolls. Instead, other surfaces (such as a heated flat surface) can be used in place of a hot roll, with the logs L being pressed against the hot surfaces as they move through and/or out of the tail sealer system 2, 102, 202. The tail sealer systems 2, 102, 202 disclosed above and illustrated in the figures which employ such other methods to complete the sealing of logs L also fall within the spirit and scope of the present invention. Also, it should be noted that the motors driving the indexer shaft 18, 118, 218, the nip rollers 24, 124, 224, 160, the tension rollers 26, 126, 226, 158, the lower conveyor assembly roll 36, 136, 236, and the ironing roll 172 can be of a number of different types and sizes well-known to those skilled in the art. The aforementioned motors can be of a type either providing feedback to closed loops (sending information regarding motor torque, velocity, and/or position to a controller) or not providing feedback. Motors providing feedback can be servo motors or otherwise, with the feedback being used to control the operation of the elements driven by the respective motors. The various types of motors which can be used in the present invention are well-known to those skilled in the art, and are therefore not described in greater detail herein.

Although the preferred embodiments of the present invention employ sprayers 42 in the adhesive assemblies 8, 108, 208, one having ordinary skill in the art will appreciate that a number of alternative devices can be used to apply a line or pattern of adhesive upon log tails in the adhesive application positions described above. For example, the adhesive assembly 8, 108, 208 can have an adhesive applicator roll mounted for rotation to continuously bring adhesive from an adhesive reservoir to the tail. The adhesive applicator roll can be mounted for axially reciprocating movement toward and away from the tail in a manner well-known to those skilled in the art, thereby transferring adhesive to the tail in each reciprocation of the adhesive applicator roll. This roll can dip into a tank of adhesive during each reciprocation, or come into contact with one or more other rolls rolling in the adhesive. In such an embodiment, at least one adhesive roll is mounted for rotation parallel to the passing tails, and collects adhesive upon its surface as it rotates. Rotation of the adhesive roll transmits adhesive up from the adhesive reservoir to a position adjacent to the tails. Adhesive rolls and their control and powering are well known to those skilled in the art are not therefore described further herein. In the preferred embodiment of the alternative adhesive assembly just described, two adhesive applicator rolls can be used—one rotating roll receiving adhesive from the adhesive reservoir and another adjacent rotating roll receiving adhesive from the first roll and transmitting the adhesive to the adhesive application position beside the tail. Alternatively, the tail support 40, 140, 240 can be mounted for pivotal rotation about its upper end and can be rotated in a conventional manner to bring the tail T to the adhesive application roll in order to apply the adhesive to the tail T.

In another alternative embodiment, the adhesive assembly 8 has a dip arm pivotable from a position in which the end of the dip arm is immersed in an adhesive reservoir to a position in which the end is brought into contact with the tail T or log L. The system controller can control the speed and position of the arm to synchronize the arm movements with the regular frequency of tails T and logs L entering the adhesive application position or to trigger movement of the arm when the location of the log L or tail end is measured and determined to be in the adhesive application position as described in the preferred embodiments above. Alternatively, the conventional driver or actuator pivoting the arm can be triggered by one or more sensors detecting the presence or approach of tails T or logs L into the adhesive application position.

One having ordinary skill in the art will recognize that still other conventional adhesive application devices and assemblies can be used to transmit adhesive to the adhesive application position, including without limitation an adhesive fountain forming a bead of adhesive at the adhesive application position, an adhesive sponge, felt, or brush wet with adhesive and located at the adhesive application position, and the like. With regard to any of the alternative applicators, adhesive can be applied upon the tail in virtually any desired pattern.

The precision required of the tail position at the adhesive application position 80 can vary depending upon the type of adhesive applicator used. For example, the location of a tail in the adhesive application position 80 when adhesive sprayers 42 are used can be less demanding than when adhesive rolls or other applicator types are used. The tail sealer systems 2, 102, 202 described above and illustrated in the figures positions the tail T in a highly accurate and repeatable manner, and so therefore is well suited to be used with virtually any conventional adhesive applicator (including the adhesive applicator assembly 8 of the preferred embodiment described above).

As described above, it is desirable to enclose the adhesive application assembly 8 as much as possible to prevent adhesive spray from escaping and fouling other areas of the tail sealer system 2, to block the entry of dust and other contaminants, and to prevent drafts and air currents from adversely affecting the adhesive applicating process. In this regard, the adhesive application position 80 can be at least partially covered or enclosed. Walls on the tail sealer frame (not shown) can be used to at least partially enclose the adhesive application position 80 from the sides. To cover the top of the adhesive application position 80, however, a dust guard 94 can be mounted for movement into and out of a position over the adhesive application position 80. The dust guard 94 is preferably a light piece of sheet material such as plastic, aluminum, or the like, but can instead be made of any other material such as fabric or plastic sheeting (upon a suitable frame), steel, and the like. The dust guard 94 preferably extends substantially the entire length of the lower winding roll 28 and from the adhesive application assembly 8 to the lower winding roll 28, and can be of one-piece construction or of multiple pieces preferably fastened together in any conventional manner.

The dust guard 94 is preferably mounted for pivotal movement about a dust guard pivot 96, and is preferably biased into its covering position shown in FIGS. 16 and 17 by its own weight. Alternatively, one or more conventional actuators, springs, and other devices can be used to bias the dust guard 94 in its covering position. To limit the travel of the dust guard 94 toward and away from its covering position and to control the speed at which the dust guard 94 falls to its covering position, an air cylinder 98 can be attached to the dust guard pivot 96 as shown or can be even be attached directly to the dust guard 94 in a conventional manner. Other shock absorbing and motion limiting devices are well known to those skilled in the art and can be used in place of the preferred air cylinder 98.

The dust guard 94 can be raised to permit passage of the sheet product in a number of different manners. In some embodiments, a cam arm 99 can be attached to the dust guard pivot 96 and can be cammed against by a passing carriage, arm, or other structure to lift the dust guard 94. For example, and with reference to the rewinder illustrated in FIG. 20, cores C can be carried by a set of fingers 97 into the adhesive applicating position 80 described above. These fingers 97, or other elements associated with the fingers, or other movable structure can cam against the cam arm 99 to lift the dust guard 94 in order to permit passage of the cores C to downstream operations.

In other embodiments, the dust guard pivot 96 can be connected in a conventional manner to a motor, actuator, or other driving device to rotate the pivot 96 and to thereby move the dust guard 94 to different positions as desired. The dust guard 94 can instead be mounted for translational movement into and out of its covering position shown in FIGS. 16 and 17 by being connected to one or more actuators, mounted upon a gear and rack assembly, slid along one or more tracks, and the like. Alternatively, the dust guard 94 can be positioned by being rotated in its own plane about a pivot driven and controlled in any conventional manner. Motion sensors can be mounted in the tail sealer or rewinder to detect the location or movement of the product or other machine elements and to thereby control when the dust guard 94 should be moved into or out of its covering position. The driving device of the dust guard 94 can instead be connected to a system controller for activation at desired times in the operational cycle of the machine (as is well known to those skilled in the art). Still other dust guard positioning devices and assemblies can be connected and controlled in conventional manners to perform the functions described above and illustrated in the figures. Such devices and assemblies fall within the spirit and scope of the present invention.

Having thus described the invention, what is claimed is:

1. A tail sealing apparatus for sealing a log tail to a log, the tail sealing apparatus comprising:

a roller rotatable about an axis and upon which the log is rollable, the roller rotatable from a first position in which the tail extends a first length from the log to a second position in which the tail extends a second length from the log, the first length being shorter than the second length;

at least one conveyor extending away from and at least partially recessed in the roller; and an adhesive applicator located adjacent to the at least one conveyor and configured and arranged to apply adhesive toward the at least one conveyor and upon the tail when the roller is in the second position.

2. The tail sealing apparatus as claimed in claim 1, further comprising a sensor positioned to detect tail presence upon the roller.

3. The tail sealing apparatus as claimed in claim 1, further comprising at least one jet positioned to blow the tail off of the log and upon the roller.

4. The tail sealing apparatus as claimed in claim 1, further comprising at least one jet directed at least partially along the at least one conveyor to maintain tail position across the at least one conveyor.

5. A method of sealing a log tail to a log, the method comprising:

rolling the log upon a roller to unwind the tail from the log;

passing the tail from the roller to at least one conveyor adjacent to and at least partially recessed in the roller;

applying adhesive to the tail when the tail reaches a desired length along the at least one conveyor;

reversing rotation of the roller to wind the tail upon the log;

rolling the log off of the roller; and sealing the tail upon the log.

6. The method as claimed in claim 5, further comprising the steps of:

rotating the roller to roll the log thereupon;

detecting an end of the tail upon the roller; and reversing rotation of the roller prior to unwinding the tail.

7. The method as claimed in claim 6, wherein:

the position upon the roller is a nip position between the roller and a surface located a distance from the roller; and the step of rotating the roller to roll the log includes rolling the log between the roller and the conveyor assembly.

8. The method as claimed in claim 7, wherein the log remains in the nip position during the step of unwinding the tail.

9. The method as claimed in claim 5, further comprising blowing fluid upon the tail while unwinding the tail.

10. The method as claimed in claim 5, further comprising:

sensing a location of the tail in an adhesive application position; and sending a signal to apply adhesive to the tail.

11. The method as claimed in claim 5, wherein the log remains in one position for at least a portion of time while the tail is wound upon the log.

12. The method as claimed in claim 5, wherein the log moves position with respect to the roller after adhesive is applied to the tail and before the tail is completely wound upon the log.

13. A tail sealer apparatus for sealing a tail of a log to the log, the tail sealer comprising:

a roller mounted for rotation and upon which the log is rollable, the roller rotatable from a first position in which the tail extends a first length from the log to a second position in which the tail extends a second length from the log, the first length being shorter than the second length, the first position separated from the second position by an amount of rotation of the roller;

a sensor positioned to detect tail position on the roll and to determine when the roller is in the first position; and an adhesive applicator located adjacent the roller, the adhesive applicator configured and arranged to apply fluid to one of the tail or the log when the roller has been rotated from the first position to the second position.

14. The tail sealer apparatus as claimed in claim 13, wherein the adhesive applicator has at least one adhesive sprayer.

15. The tail sealer apparatus as claimed in claim 14, wherein the at least one adhesive sprayer is positioned to spray adhesive upon the tail when the roller is in the second position.

16. The tail sealer apparatus as claimed in claim 13, wherein the sensor is a first sensor, the tail sealer apparatus further comprising a second sensor positioned to detect the tail in the second position of the roller.

17. The tail sealer apparatus as claimed in claim 13, further comprising a tail support extending away from the roller, the adhesive applicator and the tail support being located on opposite sides of the tail when the roller is in the second position.

18. The tail sealer apparatus as claimed in claim 17, wherein the adhesive applicator has at least one adhesive sprayer directed toward the tail support.

19. The tail sealer apparatus as claimed in claim 13, further comprising an upper conveyor located a distance from the roller and defining a log nip position between the upper conveyor and the roller.

20. The tail sealer apparatus as claimed in claim 13, further comprising at least one fluid jet positioned to blow the tail off of the log and upon the roller.

21. A method of sealing a log tail to a log, the method comprising the steps of:

rolling the log upon a roller to unwind the tail from the log;

measuring an amount of roller rotation to determine an amount of tail unwound from the log;

applying adhesive to the tail when the tail reaches a desired length;

reversing rotation of the roller to wind the tail upon the log; and rolling the log off of the roller; and sealing the tail upon the log.

22. The method as claimed in claim 21, further comprising blowing the tail upon the roller prior to rolling the log upon the roller to unwind the tail from the log.

23. The method as claimed in claim 22, further comprising reversing rotation of the roller after blowing the tail upon the roller and before unwinding the tail from the log.

24. The method as claimed in claim 23, wherein reversing rotation of the roller is initialized by detection of an end of the tail upon the roller by a sensor.

25. The method as claimed in claim 21, wherein adhesive is applied to the tail via at least one adhesive sprayer coupled to a controller and to the roller, the controller responsive to roller rotation by activating the at least one adhesive sprayer in at least one position of the roller corresponding to the desired length of the tail.

26. A tail sealing apparatus for sealing a tail of a log to the log, the tail sealing apparatus comprising:

a vacuum roller mounted for rotation and upon which the log is rollable;

a conveying surface located a distance from the vacuum roll to define a space between the conveying surface and the vacuum roll through which the tail can extend; and an adhesive applicator located adjacent to the vacuum roller, the adhesive applicator configured and arranged to apply adhesive to one of the tail and the log when the tail is drawn against the vacuum roller.

27. The tail sealing apparatus as claimed in claim 26, further comprising a sensor positioned to monitor the tail in at least one location on the vacuum roller, the sensor coupled to the adhesive applicator to trigger the adhesive application upon one of the tail and the log.

28. The tail sealing apparatus as claimed in claim 20, further comprising at least one jet positioned to exert force upon the tail against the vacuum roll.

29. The tail sealing apparatus as claimed in claim 26, wherein the adhesive applicator has at least one adhesive sprayer.

30. The tail sealing apparatus as claimed in claim 26, wherein the surface is a surface of a rotatable roller located a distance from the vacuum roller.

31. A method of sealing a log tail to a log, the method comprising:

rotating a vacuum roller a distance from a conveying surface;

rolling a log on the vacuum roller responsive to rolling the vacuum roller;

holding the tail against the vacuum roller between the vacuum roller and the conveying surface;

drawing the tail between the vacuum roller and the conveying surface;

winding the tail upon the log while holding the tail against the vacuum roller; and applying adhesive to one of the log or the tail prior to completely winding the tail upon the log.

32. The method of sealing a log tail to a log as claimed in claim 31, further comprising detecting an end of the tail upon the vacuum roller.

33. The method of sealing a log tail to a log as claimed in claim 31, further comprising blowing fluid upon the tail.

34. The method of sealing a log tail to a log as claimed in claim 31, further comprising:

detecting a location of the tail; and sending a signal to apply adhesive to the tail.

* * * * *